US007207649B2

(12) United States Patent
Ide et al.

(10) Patent No.: US 7,207,649 B2
(45) Date of Patent: Apr. 24, 2007

(54) INK JET RECORDING APPARATUS

(75) Inventors: Daisaku Ide, Tokyo (JP); Hirokazu Yoshikawa, Kanagawa (JP); Hitoshi Nishikori, Tokyo (JP); Takeshi Yazawa, Kanagawa (JP); Atsuhiko Masuyama, Tokyo (JP); Akiko Maru, Kanagawa (JP); Hiroshi Tajika, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 306 days.

(21) Appl. No.: 10/921,213

(22) Filed: Aug. 19, 2004

(65) Prior Publication Data

US 2005/0041056 A1 Feb. 24, 2005

(30) Foreign Application Priority Data

Aug. 21, 2003 (JP) ..... 2003-297679

(51) Int. Cl.
*B41J 2/165* (2006.01)

(52) U.S. Cl. ..... 347/23; 347/29; 347/30; 347/32

(58) Field of Classification Search ..... 347/22–35, 347/100, 105
See application file for complete search history.

(56) References Cited

U.S. PATENT DOCUMENTS 5,495,271 A * 2/1996 Koitabashi et al. ..... 347/23
6,527,361 B1 3/2003 Gotoh et al.
6,530,642 B1 3/2003 Uchikata et al.
2002/0008729 A1 1/2002 Kaneko et al.
2004/0041875 A1 3/2004 Yazawa et al.
2004/0104974 A1 6/2004 Edamura et al.

FOREIGN PATENT DOCUMENTS

JP 407171975 A * 7/1995
JP 2001-138552 5/2001
JP 2001-171119 6/2001

* cited by examiner

*Primary Examiner*—Shih-Wen Hsieh
(74) *Attorney, Agent, or Firm*—Fitzpatrick, Cella, Harper & Scinto

(57) ABSTRACT

An ink ejection nozzle constituting section for performing printing with a high image quality and an ink ejection nozzle constituting section for performing full-color printing at a high speed are separately disposed in one ink jet head. A recovery system is capable of performing suction recovery only in each of the nozzle constituting sections, and the suction recovery optimized for each constituting section is carried out. Accordingly, an increase in size of a recording apparatus can be restrained, and total ink consumption can be suppressed at the time of maintenance.

21 Claims, 16 Drawing Sheets

INK JET RECORDING APPARATUS

BACKGROUND OF THE INVENTION

1. Field of the Invention

The present invention relates to a serial scanning type ink jet recording apparatus in which recording with a high image quality is consistent with full-color recording at a high speed, particularly to an ink jet head constitution for simultaneously realizing both the recording with a high image quality and the full-color recording at a high speed, and a maintenance method of the constitution.

2. Related Background Art

An ink jet recording apparatus is capable of forming an image by superimposition of three primary colors by cyan ink, magenta ink, and yellow ink, which is called subtractive color mixture. Furthermore, in addition to the three colors of ink, black ink capable of representing a high contrast, and light ink (light cyan ink, light magenta ink) whose content of a color material is lowered in order to raise gradation are used, and accordingly an output image having a photograph image quality can be obtained. Techniques such as miniaturization of ejected ink droplets and the like have also been introduced in order to reduce a grained state of the output image, and it is possible to form a high-quality image.

In recent years, for further enhancement of the image quality, special ink (in colors other than cyan, magenta, and yellow) representing a color gamut which cannot be reproduced by the above-described six colors of ink has been used, or color pigment ink for enhancing a keeping quality of the output image has been used. Alternatively, a solution or the like which is imparted or applied before or after the ink is ejected to a recording medium to enhance gloss, has been used.

For example, in Japanese Patent Application Laid-Open No. 2001-138552, an ink jet recording apparatus has been described which is provided with orange and green ink for expanding a reproducible color gamut, in addition to black, cyan, magenta, yellow, light cyan, and light magenta ink.

On the other hand, a printing speed for outputting the image has been rapidly raised by progress in a device (ink jet recording head, or scanning means for scanning a carriage on which the ink jet recording head is mounted) for ejecting the ink to the recording medium.

For example, in a serial scanning type ink jet recording apparatus in which a carriage is reciprocated/moved in a main scanning direction to perform the recording, the printing speed is raised by the following measures.

(i) A maximum response frequency of ink ejection at the time of the ejecting of the ink from the ink jet recording head is raised to increase a scanning speed of the carriage.

(ii) The number of nozzles which eject the ink is increased in the ink jet recording head. Concretely, when the number of the nozzles arranged in a direction (referred to also as a sub-scanning direction) crossing the scanning direction of the carriage is increased, a width recordable in one scanning time is increased. It is to be noted that the nozzles which eject the ink are also referred to as ejection ports.

(iii) Nozzle arrays of the color ink in the ink jet recording head are arranged symmetrically in the scanning direction, and reciprocating printing is performed using the ink jet recording head (described in Japanese Patent Application Laid-Open No. 2001-171119). Even when inks of the same color are mixed on the recording medium, when an order of colors to be attached to the recording medium changes, a difference is generated in a dyestuff attached state in the medium, and a color development property largely differs.

To solve the problem, a color arrangement order is unchanged at the time of the scanning in either forward or backward direction. In this constitution, even when the scanning direction changes, the color arrangement order does not change, and therefore color unevenness by the color development difference is not generated.

However, since the ink jet recording apparatus is a system for converting input image data into the output image using a solution of ink as a medium, a maintenance technique is a very important element. Even when many types of ink are used for the enhancement of the image quality, or the device for ejecting the ink is developed in order to raise the printing speed as described above, it is a large technical problem to normally eject the ink from the ink jet recording head. Here, major problems requiring the maintenance technique will be briefly described.

(a) During the recording of the input image data, the ink evaporates in the ejection port which does not eject any ink among a plurality of nozzles arranged in the ink jet recording head, viscosity of the ink in the ejection port increases, the ink cannot be ejected stably with usual ink discharge energy, and an ejection defect is generated.

(b) During the recording, ink droplets ejected from the nozzle also include fine ink droplets (referred to also as mist) in addition to main ink droplets. When the fine ink droplets stick around the ink ejection ports of the ink jet recording head, a rectilinear property of the ink ejection is hampered.

(c) When bubbles exist in a portion of an ink reservoir in the ink jet recording head, a gas passed through the ejection port or a material constituting the ink jet recording head is incorporated into the bubbles to grow, or the bubbles expand by a temperature rise at the time of the printing. Therefore, ink supply from an ink tank is hampered. As a result, printing defects are generated.

Maintenance techniques for solving these problems (a) to (c) are as follows.

(a) A predetermined amount of ink is ejected to discharge the ink whose viscosity has increased, separately from the printing at a time when the image is formed on the recording medium, in accordance with a time, environment and the like in which any ink is not ejected (the operation will be hereinafter referred to as preliminary ejection).

(b) The number of ejection times when the ink droplets are ejected from the ejection ports is counted. When the counted number exceeds a predetermined value, a plane (hereinafter referred to as the face) in which the ejection ports of the ink jet recording head are formed is wiped with a rubber blade or the like to remove the attached ink (the operation will be hereinafter referred to as the wiping).

(c) The ink is drawn out from the ejection port using a pump, and a recovery operation is performed to discharge the ink in the ejection port (the operation will be hereinafter referred to as the suction recovery).

Furthermore, in the ink jet recording apparatus in which the ink jet recording head is separable from an ink tank and the ink tank is replaceable, the suction recovery is performed even after the replacement of the ink tank.

The wiping and the suction recovery will be briefly described with reference to the drawings.

FIG. 7 is a drawing showing the wiping. Reference numeral 1101 denotes a rubber blade which performs the wiping, 1102 is a surface (hereinafter referred to also as the face) to be wiped in which ejection ports are formed, 1103 denotes ink ejection ports, 1104 denotes attached ink which hampers the ejecting, and 1105 denotes a wiping direction. In the wiping, as shown, when the rubber blade 1101 pressed onto the ink jet recording head is moved in the direction 1105, the attached ink 1104 is brought into contact with the blade and wiped off the face.

FIG. 8 is an explanatory view of the suction recovery. Reference numeral 1201 denotes an ink jet recording head, 1202 denotes ink ejection nozzles, 1203 denotes a face, 1204 denotes a suction cap, 1205 denotes a tube for discharging the ink, and 1206 denotes a suction pump which generates a negative pressure to draw out the ink. In the suction recovery, in general, the rubber suction cap 1204 is allowed to abut on the face 1203 or brought into close contact with the face, the suction pump 1206 is rotated in a direction of an arrow 1207 to generate a negative pressure, and accordingly the ink in the ink jet recording head 1201 is drawn out into the suction cap 1204 via the ink ejection ports 1202, and discharged from the ink discharging tube 1205.

The above-described maintenance technique is largely influenced by an ink system selected in the ink jet recording apparatus, and especially system constitutions of the wiping and suction recovery techniques change. Next, this respect will be described.

(1) Ink System in which any Reaction is not Caused at the Time of Contact of the Ink When the ink for use in the ink jet recording apparatus is all-color dye ink or all-color pigment ink, there is not any special problem even in mixture of different colors of the ink. Therefore, the rubber blade for use in the wiping, or the suction cap for use at the time of a recovery operation such as suction recovery can be integrated, and a system can be constituted of members common to all colors.

(2) Ink System in which any Reaction is not Caused at the Time of the Contact of the Ink and in which Black Ink is Used as Pigment Ink for Enhancing a Black Character Quality Level in Plain Paper In general, the pigment ink is remarkably different from the color dye ink in ink jet ejection performance and maintenance property. Therefore, when the pigment ink is mixed into the ejection port of the dye ink, the ejection performance changes, and ejection defects are caused. Therefore, independent members or the same members as branched are used in rubber blade members in such a manner that the members do not contact each other at the time of the wiping. A system constitution is required in which at least two chambers are disposed in the suction cap in such a manner as to prevent the pigment ink from being mixed with the dye ink and in which the ink is discharged from another tube for discharging the ink.

(3) Ink System which Reacts to the Contact of the Ink

In a case of the printing on the plain paper having a low absorption fixing speed, when the black ink contacts the color ink, color mixture (referred to also as bleeding) occurs. To prevent this color mixture, ink which reacts to the contact of the pigment black ink with the dye color ink is sometimes used in order to prevent the color mixture from being caused even by the contact of the pigment black ink with the dye color ink. In this ink system, a system constitution in which the black ink does not contact the color ink in the rubber blade, suction cap section, or ink discharging tube section is required.

(4) Ink System in which a Special Solution Contacts and Reacts to the Ink

In this case, it is not preferable to bring the special solution into contact with the ink. Therefore, the system constitution in which the special solution does not contact the ink in the rubber blade or suction cap section is required in the same manner as in (3).

(5) Ink System in which the Special Solution does not React to the Ink in the Contact but Ink Properties Largely Differ For example, in an ink system using a special solution containing a large amount of solids such as polymers and ink that does not contain any solid, the special solution is largely different from the ink in ejection performance. Therefore, when the special solution is mixed via the ejection port, the ejection performance temporarily drops. Therefore, the same system constitution as that of (3) is preferable. However, this is not limited in consideration of product costs.

SUMMARY OF THE INVENTION

When special ink is to be mounted in an ink jet recording apparatus in order to perform printing with a high image quality, a section for mounting an ink tank for the special ink needs to be secured. It is necessary to dispose a nozzle array for ejecting the special ink, and an ink supply path for supplying the ink to nozzles from the ink tank for the special ink in an ink jet recording head section. Therefore, a size of an ink jet recording head increases, and an apparatus size necessarily increases. Furthermore, when suction recovery is performed as described in the above maintenance technique (c), an amount of discharged ink increases, because the special ink tank is mounted. As a result, ink consumption increases.

Moreover, to perform full-color printing at a high speed, the number of the nozzles for ejecting the ink is increased in a carrying direction, a width recordable in one scanning time is enlarged, and further the respective nozzles are preferably arranged symmetrically in a scanning direction to perform reciprocating recording. However, in any method, the number of the nozzles increases, and therefore the apparatus is enlarged. When the nozzle arrays of the respective colors are arranged symmetrically in the scanning direction, the ink supply path is bifurcated halfway or becomes otherwise complicated in order to supply the ink to two nozzle arrays positioned symmetrically. Furthermore, when the suction recovery described in the maintenance technique (c) is performed in a constitution for supplying the ink to two symmetrically positioned nozzle arrays from the ink tank of one color, the amount of the ink to be discharged increases and the ink consumption increases, as compared with the suction recovery performed in a constitution for supplying the ink to one nozzle away from the ink tank of one color.

Additionally, in the ink jet recording apparatus, one recording head contains dark ink and light ink, and the ink jet recording head is of a symmetrical type capable of performing the recording at a high speed, when the light ink of the ink jet recording head is replaced with the dark ink. In this constitution, when the ink tank is replaced, ink colors are inevitably mixed in the ink jet recording head. Therefore, in the maintenance at the time of the replacement of the ink tank, the ink needs to be discharged more than usual. That is, a space for holding the discharged ink is enlarged, and the size of the apparatus increases.

Furthermore, with the combined use of the ink systems (2) to (5), the suction cap or the discharging tube needs to be independently constituted as described above, and the apparatus size further increases.

The present invention has been developed in consideration of the problems, and objects thereof are to prevent an apparatus size from being increased, to the utmost, and to reduce total ink consumption at the time of maintenance in an ink jet recording apparatus in which recording with a high image quality is consistent with full-color recording at a high speed.

According to the present invention, there is provided an ink jet recording apparatus for performing recording on a recording medium by use of a recording head including a first nozzle array group in which a plurality of nozzle arrays having a plurality of nozzles arranged for ejecting ink are arranged corresponding to a plurality of colors of the ink, and a second nozzle array group in which a plurality of nozzle arrays having a plurality of nozzles arranged for ejecting the ink are arranged corresponding to a plurality of colors of ink different from those ejected from the first nozzle array group or the plurality of colors of ink and solution, the apparatus comprising: recovery process means capable of individually performing recovery processes for keeping ink ejection states to be satisfactory in the first and second nozzle array groups.

By application of the present invention, in the recording apparatus including a plurality of ink jet head constituting sections for ejecting a plurality of colors of ink or solution, the respective ink jet head constituting sections can be individually recovered. Therefore, it is possible to perform the recovery processes optimized for the respective ink jet head constituting sections. When a recovery operation is performed by a necessary minimum suction recovery amount in accordance with a use situation or a use purpose in this manner, an amount of ink consumed at the time of the recovery operation is reduced, and accordingly running costs can be reduced. Furthermore, the amount of ink consumed at the time of the recovery operation is small, that is, an amount of waste ink to be discharged is small. Therefore, a volume required for holding the waste ink can be reduced.

Moreover, there can be provided an ink jet recording apparatus in which maintenance optimized for a constitution is performed when performing a suction recovery operation, so that a size of the recording apparatus is prevented from being increased to the utmost, a total ink amount consumed at the time of the maintenance can be reduced, and high-speed recording is consistent with the recording with a high image quality.

DESCRIPTION OF THE PREFERRED EMBODIMENT

Embodiments of the present invention will be described hereinafter in detail with reference to the drawings.

First, an ink jet recording apparatus according to one embodiment of an ink jet recording apparatus of the present invention will be described with reference to FIGS. 1 to 6.

It is to be noted that in the present specification, "recording" indicates not only a case where significant information such as characters and figures are formed but also, broadly, a case where images, designs, patterns and the like are formed on a material to be recorded, or mediums are processed regardless of significance, or regardless of whether or not the information is visualized in such a manner that people can visually perceive the information.

Here, the "material to be recorded" refers to not only paper for use in a general printing apparatus but also, broadly, materials which are capable of accepting ink, such as cloth, plastic film, metal plates, glass, ceramics, wood, and leathers.

Furthermore, the "ink" should be broadly interpreted in the same manner as in definition of the above-described "recording", and refers to a solution usable in forming images, designs, patterns and the like or in processing the material to be recorded or treating the ink (e.g., solidifying or encapsulating color materials in the ink applied to the material to be recorded), when applied onto the material to be recorded.

(Apparatus Main Body)

Figure 1:
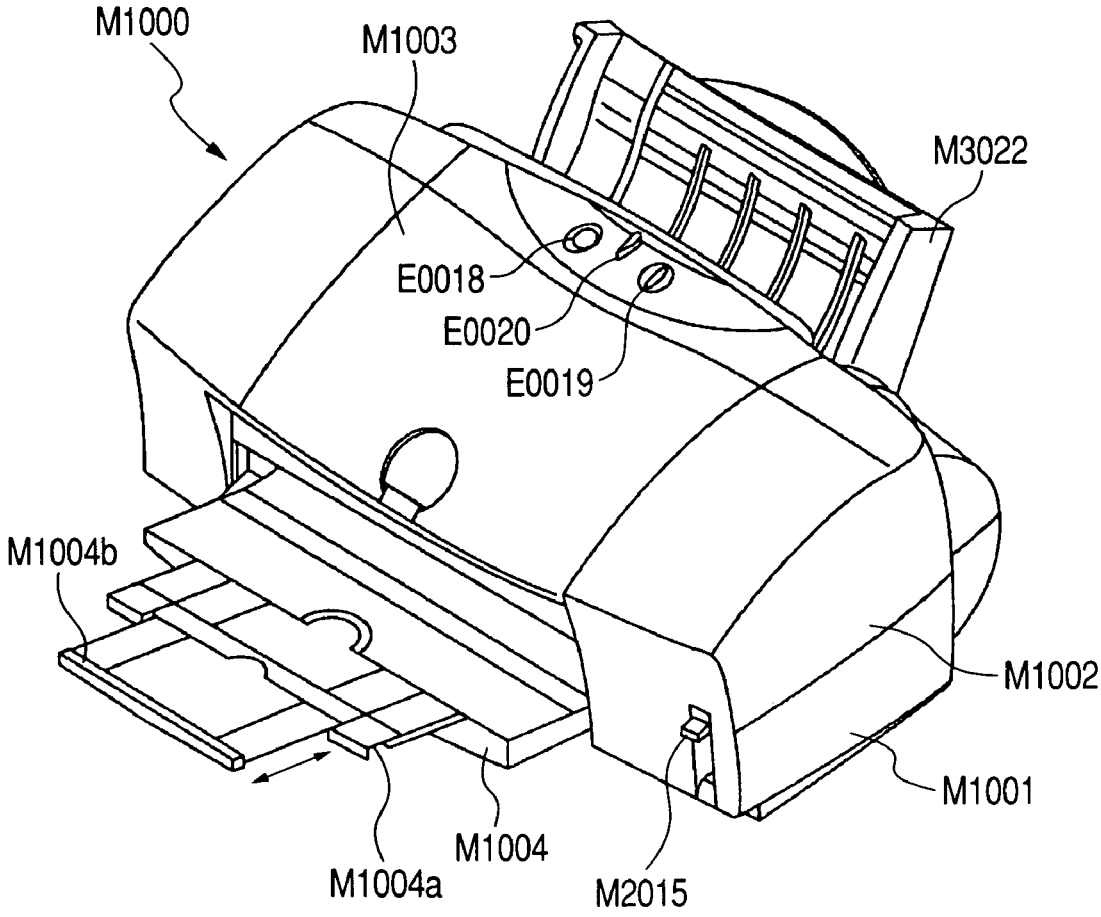
FIG. 1 is a perspective view showing an appearance constitution of an ink jet recording apparatus according to one embodiment of the present invention.
Figure 2:
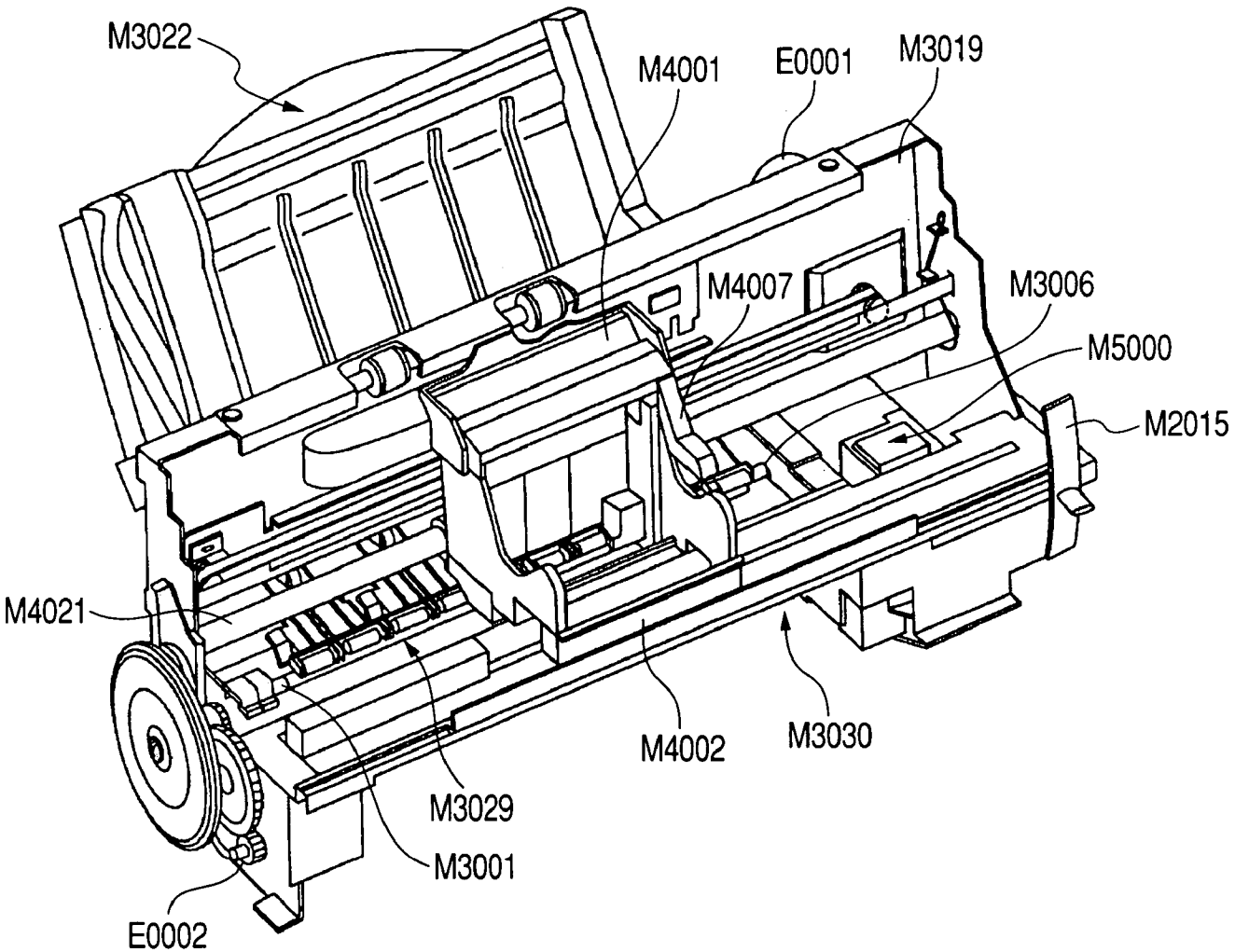
FIG. 2 is a perspective view showing a state in which exterior members of the recording apparatus shown in FIG. 1 are detached.

FIGS. 1 and 2 schematically show a constitution of a recording apparatus in which an ink jet recording system is used. In FIG. 1, an outer structure of an apparatus main body M1000 of the recording apparatus in the embodiment is constituted of exterior members including a lower case M1001, an upper case M1002, an access cover M1003, and a discharge tray M1004, and a chassis M3019 (see FIG. 2) housed in the exterior members.

In the discharge tray M1004, two auxiliary trays M1004*a*, M1004*b* are housed. If necessary, when the respective trays are drawn out forwards, a support area of a sheet can be enlarged/reduced in three stages.

One end portion of the access cover M1003 is rotatably held by the upper case M1002 in such a manner that an opening formed in the upper surface of the case is closably opened. When the access cover M1003 is opened, a recording head cartridge H1000, an ink tank H1900 and the like stored inside the main body can be replaced.

Moreover, a power key E0018 and a resuming key E0019 are pressably disposed on the upper surface of a rear part of the upper case M1002, and an LED E0020 is also disposed. When the power key E0018 is depressed, the LED E0020 is lit to inform an operator that the recording is possible. The LED E0020 has various display functions of changing a way of blinking, changing color, and informing the operator of troubles of the recording apparatus. Furthermore, a buzzer E0021 (FIG. 4) can be sounded. It is to be noted that when the troubles are solved, the resuming key E0019 can be depressed to resume the recording.

(Recording Operation Mechanism)

Next, a recording operation mechanism stored/held in the apparatus main body M1000 of the recording apparatus in the present embodiment will be described.

The recording operation mechanism in the present embodiment is constituted of: an automatic supply section M3022 for automatically feeding recording sheets P into the apparatus main body; a transport section M3029 which guides the recording sheets P sent sheet by sheet from the automatic supply section into a predetermined recording position and which guides the recording sheets P into a discharge section M3030; a recording section which performs desired recording with respect to the recording sheets P transported to the recording position; and a recovery section (M5000) which performs a recovery process with respect to the recording section and the like.

(Recording Section)

Here, the recording section will be described. The recording section is constituted of a carriage M4001 movably supported by a carriage shaft M4021, and the recording head cartridge H1000 detachably mounted on the carriage M4001.

(Recording Head Cartridge)

First, the recording head carriage for use in the recording section will be described with reference to FIG. 3.

Figure 3:
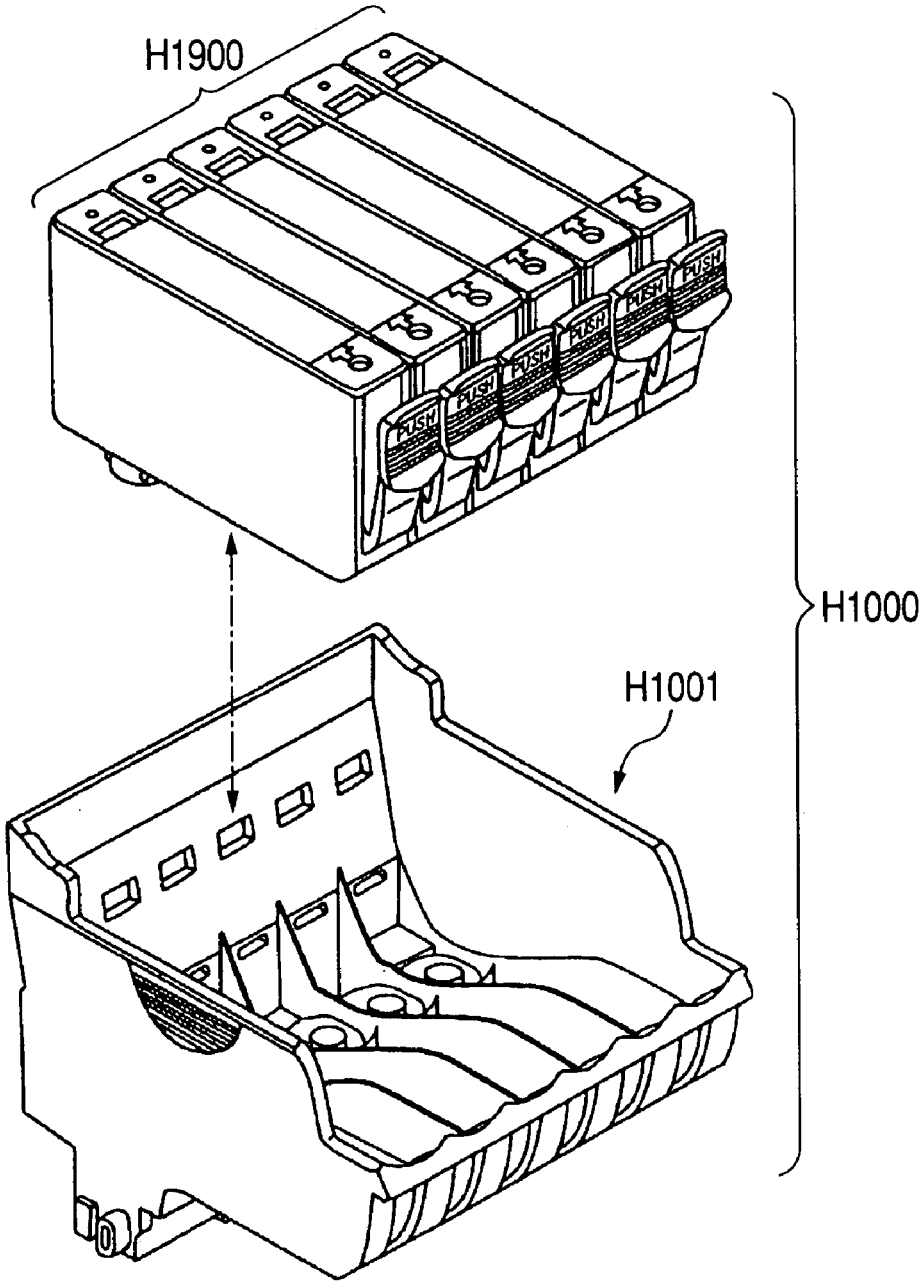
FIG. 3 is an exploded perspective view showing an ink jet head cartridge.

As shown in FIG. 3, the recording head cartridge H1000 in the embodiment has the ink tank H1900 in which the ink is stored, and a recording head H1001 which ejects the ink supplied from the ink tank H1900 from nozzles in accordance with recording information. In the recording head H1001, a so-called carriage system is adopted which is detachably mounted on the carriage M4001 described later.

In the recording head cartridge H1000 described here, the ink tanks H1900 independent for each of black, light cyan, light magenta, cyan, magenta, and yellow colors are prepared as ink tanks which make possible color recording with a high image quality as in photographs. As shown in FIG. 3, the respective ink tanks are detachably attached to the ink jet head H1001.

(Carriage)

Next, the carriage M4001 on which the ink jet head cartridge H1000 is mounted will be described with reference to FIG. 2.

As shown in FIG. 2, the carriage M4001 is provided with: a carriage cover M4002 which engages with the carriage M4001 to guide the ink jet head H1001 to a predetermined attaching position on the carriage M4001; and a head set lever M4007 which engages with a tank holder H1500 of the ink jet head H1001 to press and set the ink jet head H1001 into the predetermined attaching position.

Moreover, a contact flexible print cable (see FIG. 4, hereinafter referred to as the contact FPC) E0011 is disposed in another engaging portion with respect to the ink jet head H1001 of the carriage M4001. A contact portion on the contact FPC E0011 electrically contacts a contact portion (outer signal input terminal) H1301 disposed on the ink jet head H1001. Accordingly, various information for the recording can be transmitted/received, or power can be supplied to the ink jet head H1001.

Figure 4:
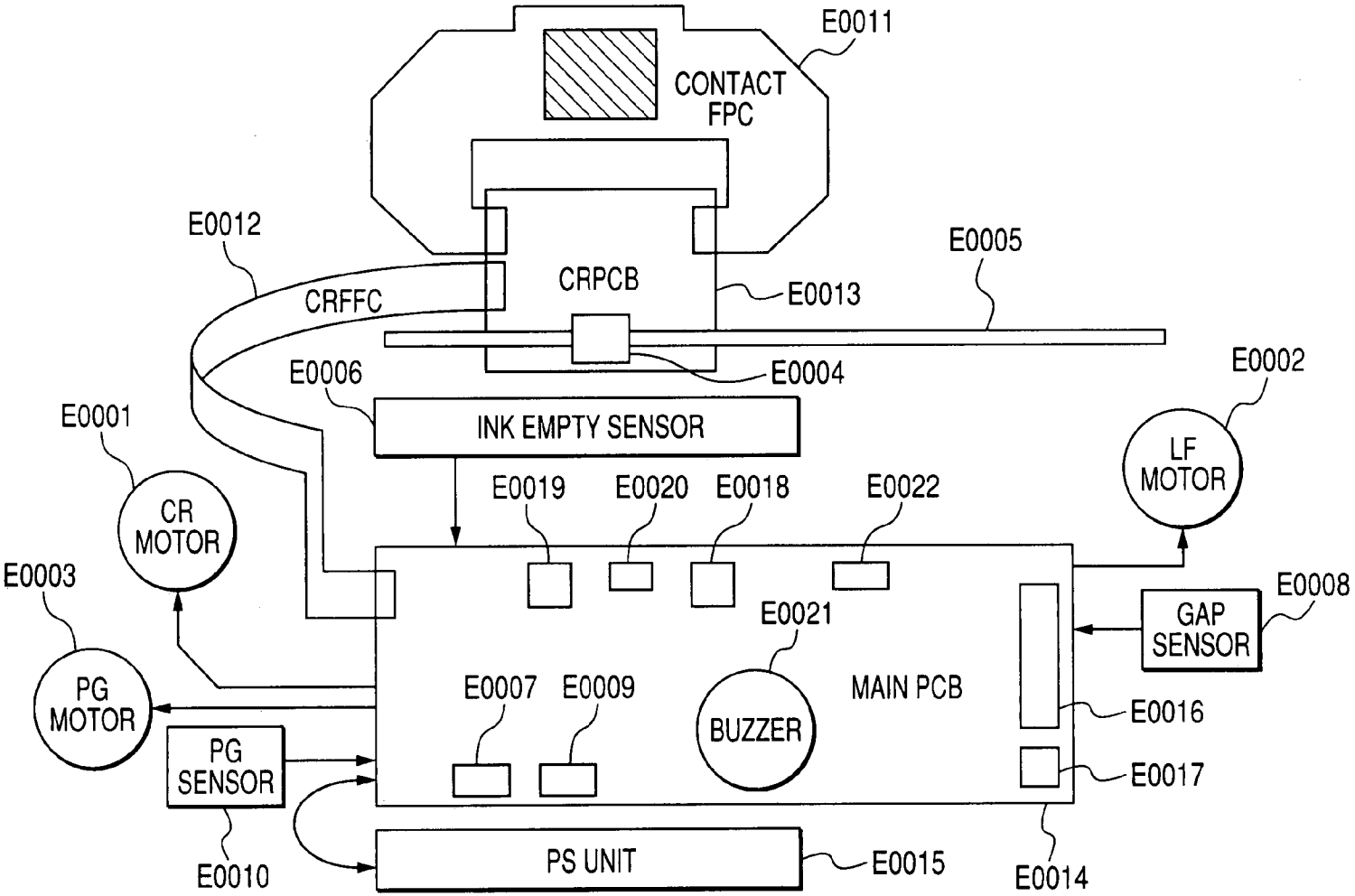
FIG. 4 is a block diagram schematically showing a whole constitution of an electric circuit in the recording apparatus according to one embodiment of the present invention.

The contact FPC E0011 is connected to a carriage substrate (or carriage base board) E0013 mounted on the back surface of the carriage M4001 (see FIG. 4).

(Constitution of Electric Circuit of Recording Apparatus)

Next, an electric circuit constitution in the embodiment of the present invention will be described.

FIG. 4 is a diagram schematically showing a whole constitution example of an electric circuit in the present embodiment.

The electric circuit in the present embodiment is constituted mainly of the carriage substrate (CRPCB) E0013, a main printed circuit board (PCB) E0014, a power supply unit E0015, and the like.

Here, the power supply unit E0015 is connected to the main PCB E0014, and supplies various driving powers.

Moreover, the carriage substrate E0013 is a printed board unit mounted on the carriage M4001 (FIG. 2), and functions as an interface which transmits/receives a signal with respect to the ink jet head via the contact FPC E0011. Additionally, the substrate detects a change in a positional relation between an encoder scale E0005 and an encoder sensor E0004 based on a pulse signal output from the encoder sensor E0004 with the movement of the carriage M4001, and outputs the output signal to the main PCB E0014 via a flexible flat cable (CRFFC) E0012.

Furthermore, the main PCB E0014 is a printed board unit which drives/controls each section of the ink jet recording apparatus in the embodiment. I/O ports with respect to paper end detection sensor (PE sensor) E0007, an automatic sheet feeder (ASF sensor) E0009, a cover sensor E0022, a parallel interface (parallel I/F) E0016, a serial interface (serial I/F) E0017, a resuming key E0019, the LED E0020, the power key E0018, a buzzer E0021 and the like are disposed on the substrate. Moreover, the main PCB is connected to a motor (CR motor) E0001 constituting a driving source for mainly scanning the carriage M4001, a motor (LF motor) E0002 constituting a driving source for conveying a recording medium, and a motor (PG motor) E0003 for use both in an operation for rotating the ink jet head and an operation for feeding the recording medium to control the driving of these motors. Additionally, the main PCB has a connection interface with respect to an ink empty sensor E0006, a GAP sensor E0008, a PG sensor E0010, the CRFFC E0012, and the power supply unit E0015.

Figure 5:
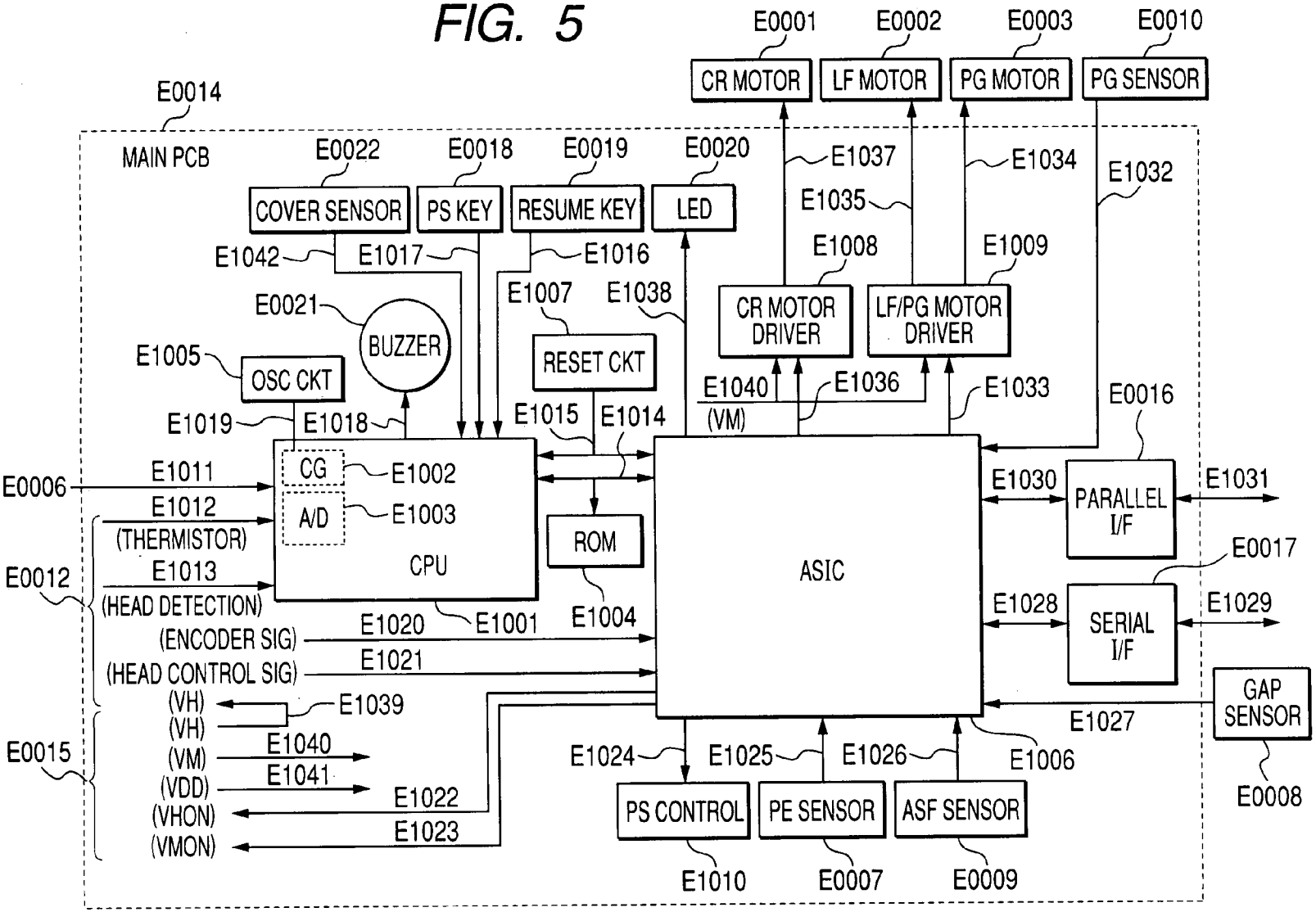
FIG. 5 is a block diagram showing an inner constitution example of a main PCB in the electric circuit shown in FIG. 4.

FIG. 5 is a block diagram showing an inner constitution of the main PCB E0014. In FIG. 5, E1001 denotes a CPU. The CPU E1001 has a clock generator (PCG) E1002 connected to an oscillation circuit E1005 therein, and produces a system clock by an output signal E1019. The CPU is connected to a ROM E1004 and an application specific integrated circuit (ASIC) E1006 via a control bus E1014 to control the ASIC E1006 in accordance with a program stored in ROM. States of an input signal E1017 from the power key, an input signal E1016 from the resuming key, a cover detection signal E1042, and a head detection signal (HSENS) E1013 are detected. Furthermore, the CPU drives the buzzer E0021 by a buzzer signal (BUZ) E1018, and detects the states of an ink empty detection signal (INKS) E1O11 connected to an A/D convener E1003 built therein and a temperature detection signal (TH) E1012 by a thermistor. Additionally, the CPU performs various logic calculation, condition judgment and the like, and generally drives/controls the ink jet recording apparatus.

A driving source of a CR motor driver E1008 is a motor power supply (VM) E1040. The driver produces a CR motor driving signal E1037 in accordance with a CR motor control signal E1036 from the ASIC E1006, and drives the CR motor E0001. E1009 denotes an LF/PG motor driver, uses the motor power supply E1040 as a driving source, generates an LF motor driving signal E1035 in accordance with a pulse motor control signal (PM control signal) E1033 from the ASIC E1006, drives the LF motor by the signal, and further produces a PG motor driving signal E1034 to drive the PG motor.

A power supply control circuit E1010 controls power supply to sensors including light emitting elements in accordance with a power supply control signal E1024 from the ASIC E1006. A parallel I/F E0016 transmits a parallel I/F signal E1030 from the ASIC E1006 to a parallel I/F cable E1031 connected to the outside, and also transmits a signal of the parallel I/F cable E1031 to the ASIC E1006. A serial I/F E0017 transmits a serial I/F signal E1028 from the ASIC E1006 to a serial I/F cable E1029 connected to the outside, and also transmits a signal of the cable E1029 to the ASIC E1006.

On the other hand, a head power (VH) E1039, the motor power (VM) E1040, and a logic power (VDD) E1041 are supplied from the power supply unit E0015. A head power ON signal (VHON) E1022 and a motor power ON signal (VMOM) E1023 from the ASIC E1006 are input into the power supply unit E0015 to control ON/OFF of the head power supply E1039 and the motor power supply E1040. The logic power (VDD) E1041 supplied from the power supply unit E0015 is converted into a voltage if necessary, and supplied to each section inside/outside the main PCB E0014.

Moreover, the head power supply signal E1039 is smoothed on the main PCB E0014, thereafter sent to the flexible flat cable E0011, and used in driving the ink jet head cartridge H1000.

A reset circuit E1007 detects a drop of the logic power supply voltage E1041, and supplies a reset signal (RESET) E1025 to the CPU E1001 and the ASIC E1006 to perform initialization.

The ASIC E1006 is a semiconductor integrated circuit of one chip, is controlled by the CPU E1001 via the control bus E1014, outputs the CR motor control signal E1036, PM control signal E1033, power supply control signal E1024, head power ON signal E1022, motor power ON signal E1023 and the like, and transmits/receives signals with respect to the parallel I/F E0016 and serial I/F E0017. Additionally, the ASIC detects the states of the PE detection signal (PES) E1025 from the PE sensor E0007, an ASF detection signal (ASFS) E1026 from the ASF sensor E0009, a GAP detection signal (GAPS) E1027 from a GAP sensor E0008 for detecting a gap between the ink jet head and the recording medium, and a PG detection signal (PGS) E1032 from a PG sensor E0010, and transmits data indicating the states to the CPU E1001 via the control bus E1014. The CPU E1001 controls the driving of an LED driving signal E1038 in such a manner that the LED E0020 blinks.

(Operation of Recording Apparatus)

Figure 6:
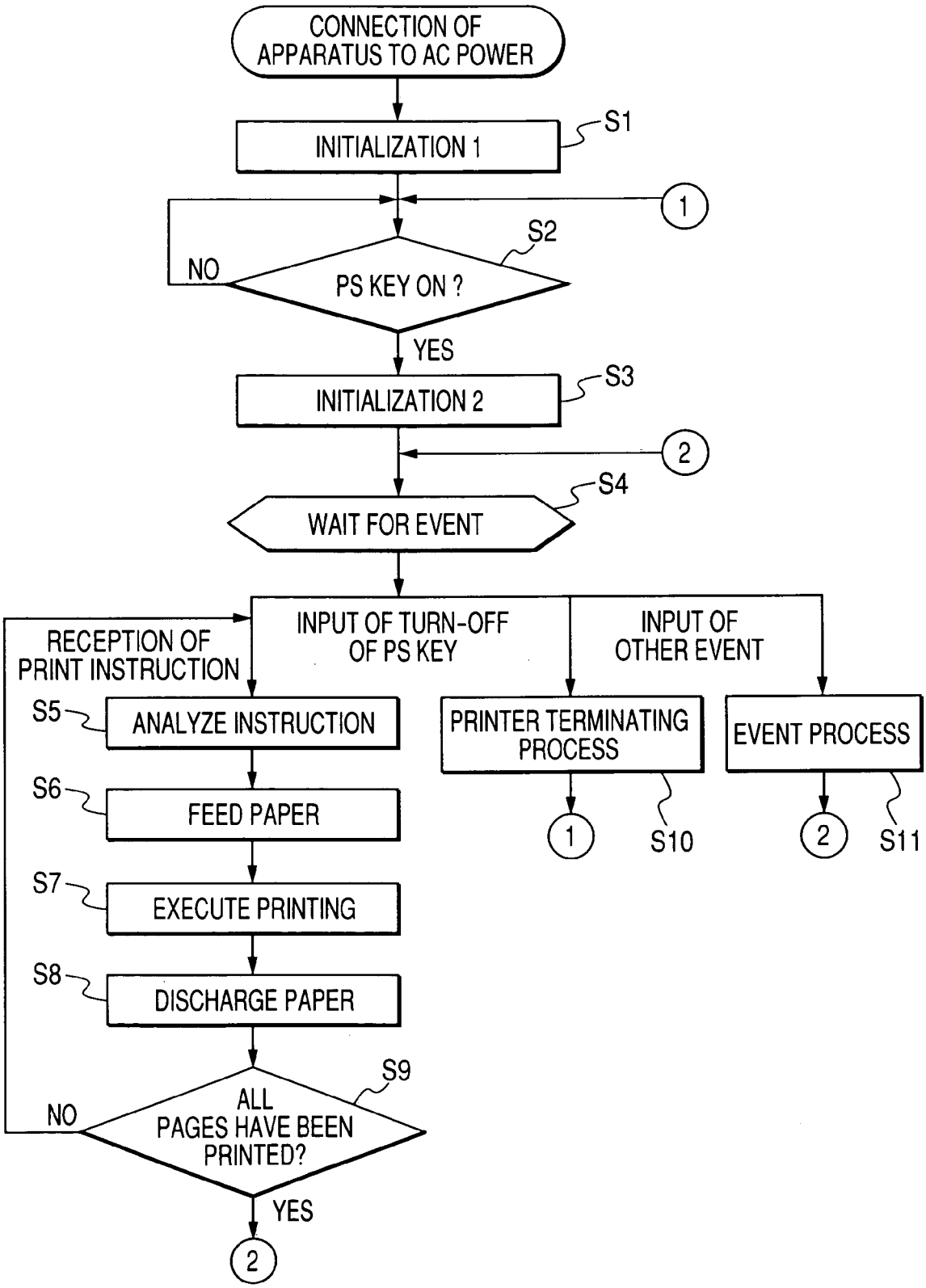
FIG. 6 is a flowchart showing an operation of the ink jet recording apparatus of the present embodiment.
Figure 7:
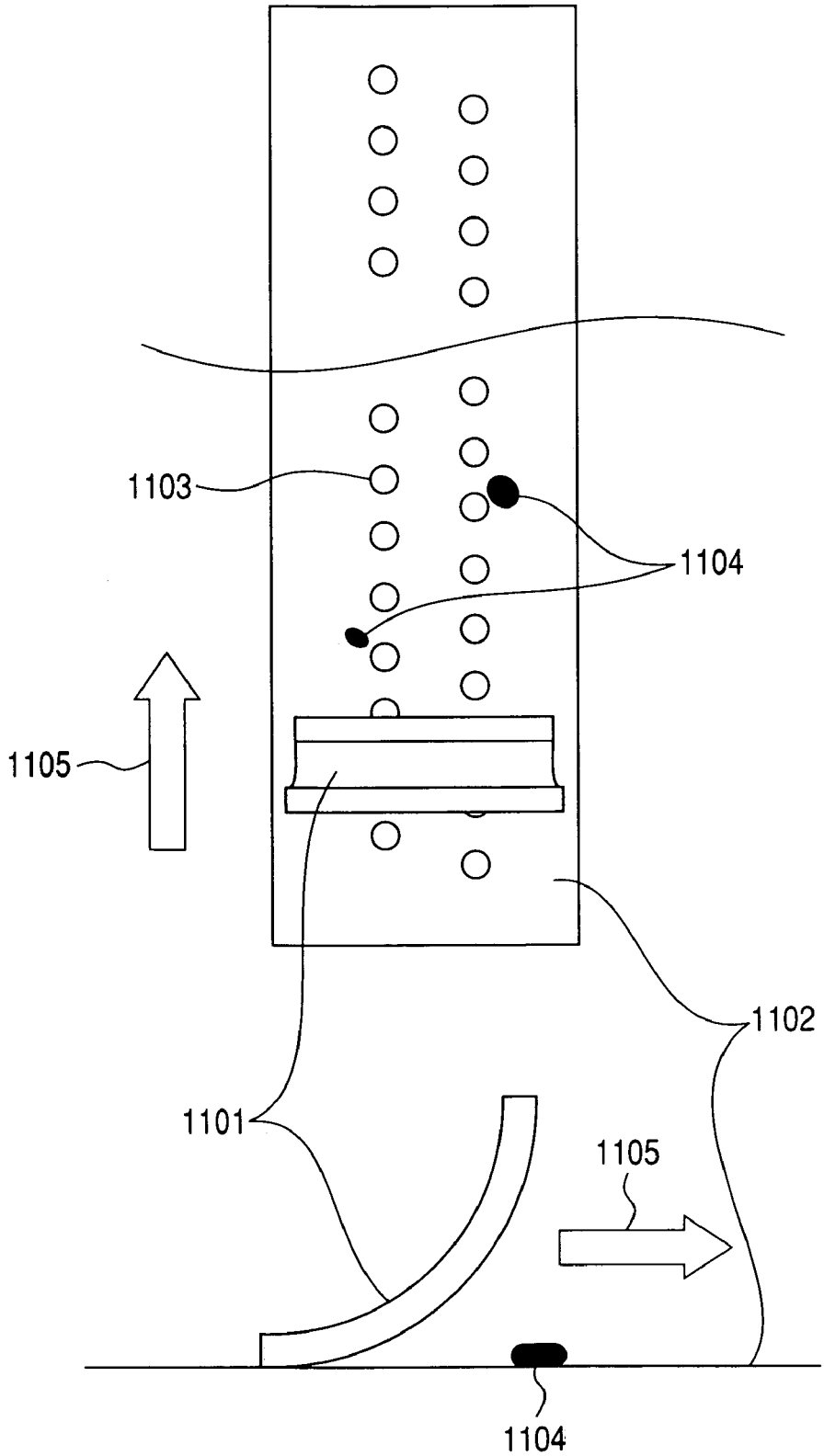
FIG. 7 is an explanatory view of wiping.
Figure 8:
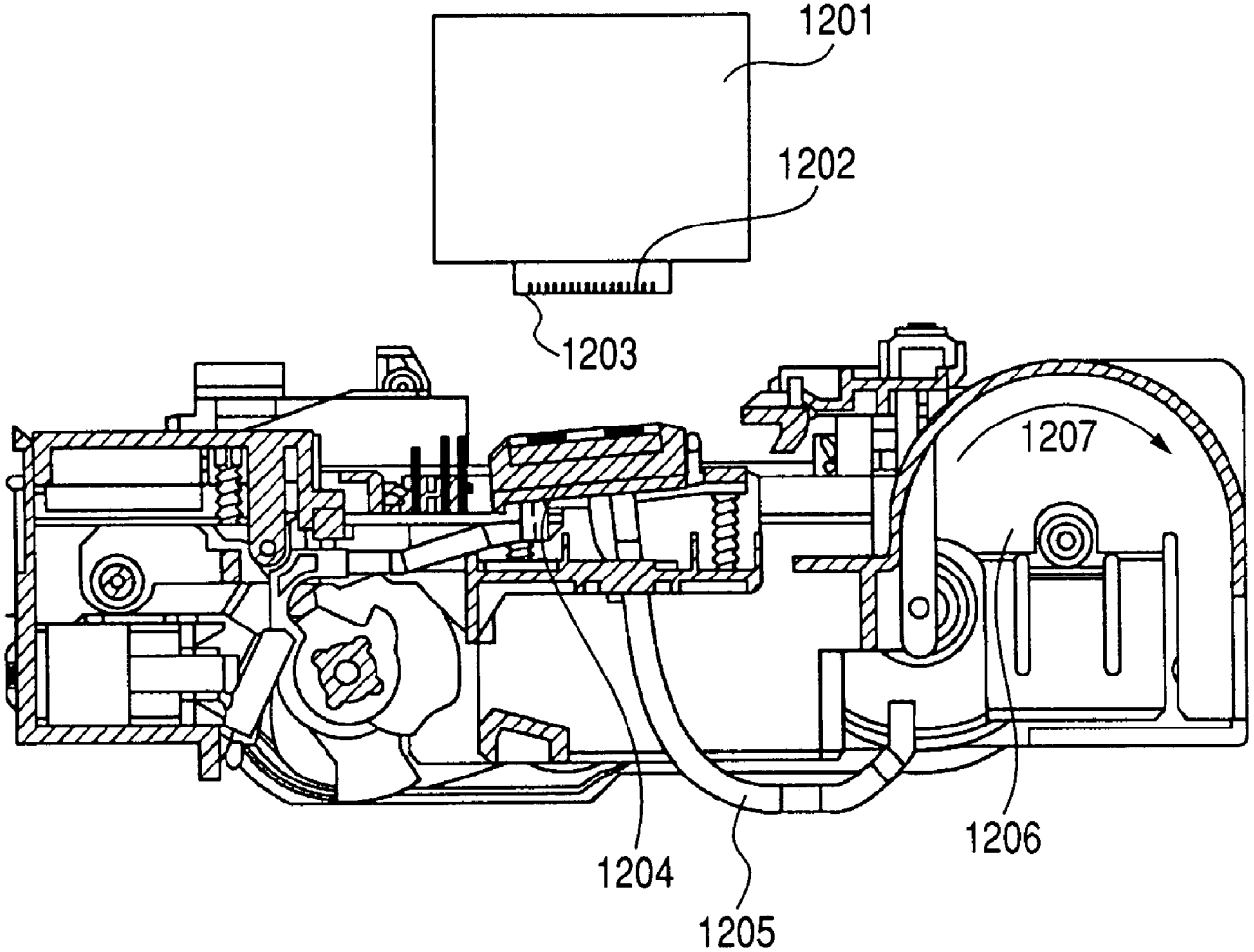
FIG. 8 is an explanatory view of suction recovery.

Next, an operation of the ink jet recording apparatus of the present embodiment constituted as described above will be described based on a flowchart of FIG. 6.

When an apparatus main body 1000 is connected to an AC power, first in step S1 a first initialization process of the apparatus is performed. In the initialization process, an electric circuit system including ROM and RAM of the present apparatus is checked, and it is judged whether or not the present apparatus is normally electrically operable.

Next, in step S2, it is judged whether or not the power key E0018 disposed on the upper case M1002 of the apparatus main body M1000 has been turned on. When the power key E0018 is pressed, the process shifts to the next step S3 to perform a second initialization process.

In the second initialization process, various driving mechanisms and the ink jet head of the present apparatus are checked. That is, to initialize various motor or to read head information, it is judged whether or not the apparatus is normally operable.

Next, step S4 waits for an event. That is, an instruction event from an external I/F, a panel key event by user's operation, an internal control event and the like are monitored. When these events are generated, the process corresponding to the event is executed.

For example, when a printing instruction event is received from the external I/F in the step S4, the process shifts step S5. When a power key event by the user's operation is generated in the step S4, the process shifts to step S10. When another event is generated in the step S4, the process shifts to step S11.

Here, in the step S5, the printing instruction from the external I/F is analyzed, designated paper type, sheet size, printing quality level, paper feed method and the like are judged, data indicating the judgment result is stored in a RAM E2005 in the present apparatus, and the process advances to step S6.

Next, in the step S6, paper feed is started by the paper feed method designated in the step S5, the sheet is fed to a recording start position, and the process advances to step S7.

In the step S7, a recording operation is performed. In the recording operation, recording data sent from the external I/F is once stored in a recording buffer. Next, the CR motor E0001 is driven to start moving the carriage M4001 in a main scanning direction. Moreover, the recording data stored in a print buffer E2014 is supplied to the ink jet head H1001 to record one line. When the recording operation of the recording data for one line ends, the LF motor E0002 is driven, and an LF roller M3001 is rotated to feed the sheet in a sub-scanning direction. Thereafter, when the above-described operation is repeatedly executed, and the recording of the recording data for one page from the external I/F ends, the process advances to step S8.

In the step S8, the LF motor E0002 is driven, a discharge roller M2003 is driven, and the paper feeding is repeated until it is judged that the sheet has been completely discharged from the present apparatus. At the end of the operation, the sheets are completely discharge onto the discharge tray M1004*a*.

Next, in step S9, it is judged whether or not the recording operation of all pages to be recorded has ended. When the pages to be recorded are left, the process returns to the step S5. Thereafter, the operation of the steps S5 to S9 is repeated. When all the pages to be recorded are recorded, the recording operation ends, and thereafter the process shifts to the step S4 to wait for the next event.

On the other hand, in the step S10, a recording apparatus end process is performed, and the operation of the present apparatus is stopped. That is, to cut off power supply to various motors, head and the like, after the power supply is brought into a disconnectable state, the power supply is cut, and the process advances to the step S4 to wait for the next event.

Moreover, in step S11, events other than the above-described events are processed. For example, a process corresponding to a recovery instruction from each of various panel keys of the present apparatus or the external I/F, or a recovery event (event for performing recovery operations such as pre-ejection, wiping, and suction recovery) produced inside the apparatus is performed. It is to be noted that after the process ends, the process advances to the step S4 to wait for the next event.

It is to be noted that one configuration in which the present invention is effectively used is a configuration in which heat energy produced by an electrothermal converting member is used, and film boiling is caused to form bubbles in the solution.

First Embodiment

Figure 9:
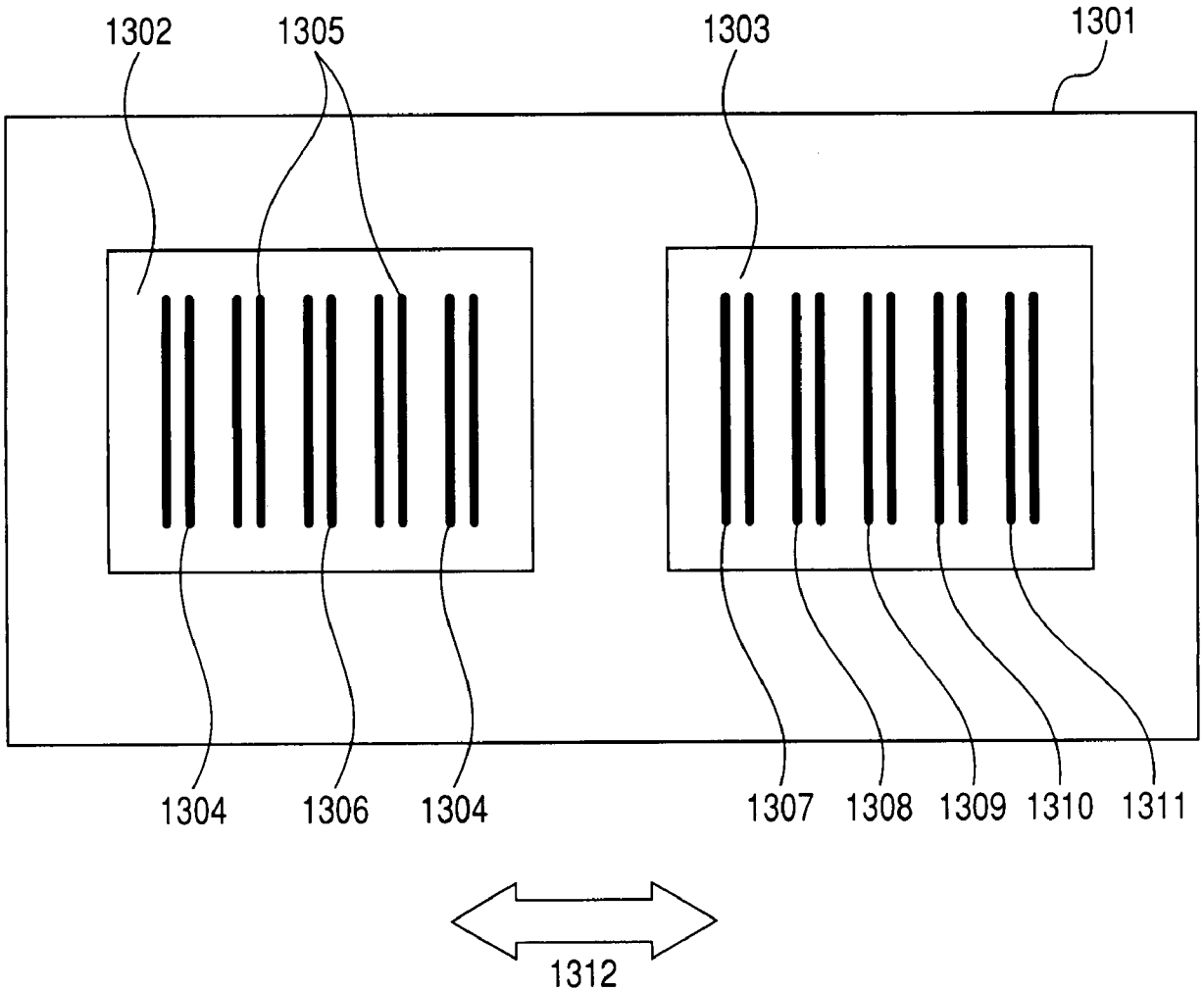
FIG. 9 is a diagram showing a constitution of an ink jet head in a first embodiment.

In the present invention, as shown in FIG. 9, in a recording apparatus which performs recording with respect to a recording medium using a recording head 1301 including a plurality of (two in the present embodiment) nozzle array groups 1302, 1303 including nozzle array groups for ejecting a plurality of colors of ink, recovery operations can be individually performed with respect to the respective nozzle array groups.

A first embodiment of the present invention will be described hereinafter in detail.

As an ink system in the present invention, an ink system (1) described above in paragraphs of the description of the related art, an all-color dye ink system in which any reaction is not caused at the time of contact of the ink, or an all-color pigment ink system is used. It is to be noted that the use of all-color dye ink, or the all-color pigment ink is a presumption, but the present invention is not limited to the use as long as an ink ejection performance, maintenance properties and the like are not influenced by color mixture of the ink.

In the present embodiment, eight types of ink are used including cyan, magenta, yellow, black, light cyan, light magenta, special ink 1, and special ink 2. If a symmetrical ink jet recording head (referred to also as the ink jet head, recording head, or head) is constituted in order to use all the eight types of ink in high-speed full-color recording, the recording head including 14 (=(8−1)types×2) nozzle arrays is used (in order to use one nozzle array only in middle ink of the recording head and to dispose the nozzle arrays for the other seven types of ink on opposite sides of the middle nozzle array. When the same maintenance is performed in all the nozzle arrays in the recording head constituted in this manner, an enormous amount of ink is consumed at the time of suction recovery. By the use of a suction cap or a wiping blade integrated for performing the recovery of all the nozzle arrays, the same amount of ink is discharged from all the nozzle arrays.

In the present embodiment, in the ink jet recording apparatus, nozzles for ejecting eight types of ink are divided and arranged in a constituting section characterizing the high-speed full-color recording and that characterizing the recording with the high image quality, and maintenance operations such as suction recovery and wiping can be performed independently in the respective constituting sections. Accordingly, the number of ink tanks (or the nozzle arrays) to be simultaneously sucked/recovered is not increased, and further ink consumption in the suction recovery is reduced.

FIG. 9 shows a constitution of the ink jet recording head in the first embodiment of the present invention.

Reference number 1301 denotes an ink jet recording head, 1302 denotes an ink jet head constituting section which characterizes the high-speed full-color recording, and 1303 denotes an ink jet head constituting section which characterizes the recording with the high image quality.

The ink jet head constituting section 1302 which characterizes the high-speed full-color recording has nozzles (also referred to as the ejection ports) for ejecting cyan ink, magenta ink, and yellow ink which are three primary colors of a color material for reproducing full colors by subtractive color mixture. The nozzles which eject the ink are arranged in a direction (referred to also as the conveying direction) crossing a scanning direction 1312 of the ink jet head substantially vertically, and a pair of nozzle arrays in which the nozzles are arranged are disposed for one color of ink. Above all, with respect to the ejection nozzle arrays for cyan ink and magenta ink which are largely different from each other in hue and whose color differences are also large, as shown by 1304, 1305 of FIG. 9, a pair of nozzle arrays are disposed in two places in such a manner that the ink jet head constituting section 1302 has a symmetrical configuration in the scanning direction. It is to be noted that nozzle arrays 1306 of yellow ink are disposed between the nozzle arrays 1305 of magenta ink, the nozzle arrays are arranged in order of cyan, magenta, cyan, magenta, and cyan. At the time of either the forward scanning and the backward scanning, the printing order can be the same.

The ink jet head constituting section 1302 in which the printing order does not change in the opposite forward/backward scanning directions is disposed in this manner. Accordingly, the reciprocating printing can be performed without causing color unevenness by a difference in color development property attributed to the printing order, and the high-speed full-color recording can be performed.

On the other hand, in the ink jet head constituting section 1303 which characterizes the recording with the high image quality, nozzle arrays for ejecting light cyan ink and light magenta ink are disposed in 1307, 1311 in order to enhance gradation of the output image, and a nozzle array for ejecting black ink is disposed in 1309 in order to enhance a contrast of the output image. Furthermore, in the present embodiment, two types of special color ink (special ink 1, special ink 2) are mounted so that a color gamut which cannot be reproduced only by three primary colors of color materials of cyan, magenta, yellow is reproducible. Therefore, the ink jet head constituting section 1303 is provided with nozzle arrays which eject two types of special color ink. It is to be noted that even in the ink jet head constituting section 1303, each of the ink nozzle arrays 1307 to 1311 is constituted of a pair of rows in the same manner as in the ink jet head constituting section 1302. It is to be noted that as the special ink, colors other than cyan, magenta, and yellow, such as orange (red), green, and blue (violet) are considered. By the use of the special ink, colors of the color gamut which cannot be represented by cyan, magenta, and yellow can be represented. It is to be noted that not only the ink but also a solution which is applied (ejected) to the recording medium to thereby enhance a gloss degree of the recording medium may be ejected from the ink jet head constituting section 1303 which characterizes the recording with the high image quality.

Thus, the nozzle arrays which eject eight types of ink are divided and disposed in the constituting section 1302 which characterizes the high-speed full-color recording and the constituting section 1301 which characterizes the recording with the high image quality. In the whole ink jet head, ten nozzle arrays in total including cyan×2, magenta×2, yellow, black, light cyan, light magenta, special ink 1, and special ink 2 are disposed. Here, the ink adopted in the present embodiment is all-color dye ink, and any problem is not caused in the maintenance system even by the contact of the ink. It is to be noted that since a plurality of nozzle arrays to eject the ink are disposed, the ink jet head constituting sections 1302, 1303 will be referred to also as the nozzle array groups. As shown in FIG. 9, the nozzle array groups of the ink jet head constituting sections 1302, 1303 are formed in different semiconductor chips, and one recording head is constituted of different semiconductor chips.

Figure 10:
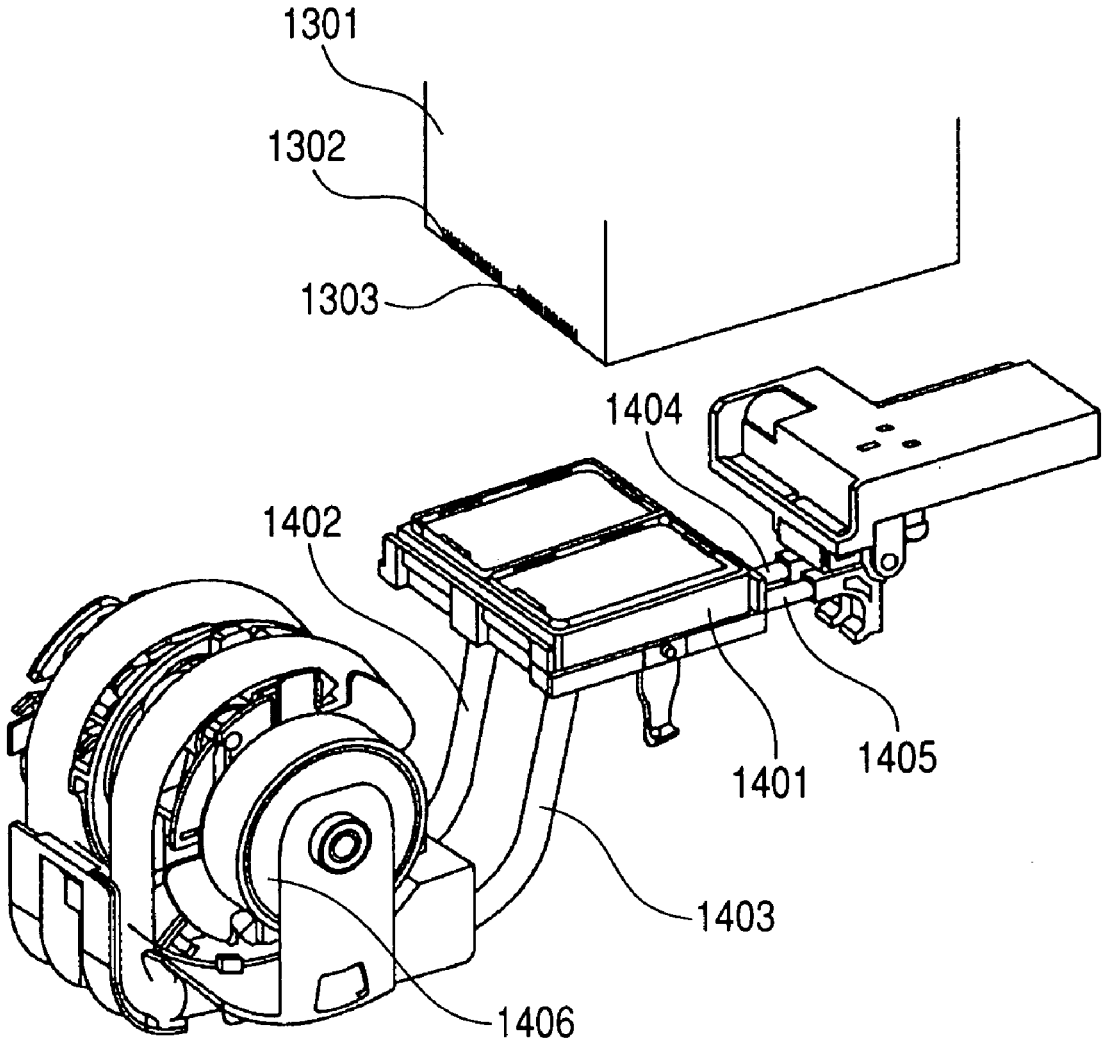
FIG. 10 is an explanatory view of separation of an ink jet head constituting section characterizing high-speed full-color printing from that characterizing printing with a high image quality.

FIG. 10 shows maintenance systems of the ink jet head constituting sections 1302, 1303.

Reference numeral 1401 denotes a suction cap provided with two chambers in such a manner that the ink jet head constituting sections 1302, 1303 can be capped, respectively, and the suction cap 1401 can abut on or press the surface of the ink jet head constituting section in which the nozzles are formed. Furthermore, atmospheric release valves 1404, 1405 are disposed in the respective chambers of the suction cap 1401. Furthermore, ink discharging tubes 1402, 1403 are independently disposed from the respective chambers of the suction cap 1401. When suction pumps are independently disposed for the respective ink discharging tubes 1402, 1403, a volume of the maintenance system increases, an apparatus size increases, and apparatus costs increase. Therefore, in the present embodiment, one suction pump 1406 is disposed for two ink discharging tubes 1402, 1403. That is, the chambers of the suction cap 1401, the atmospheric release valves 1404, 1405, and the ink discharging tubes 1402, 1403 are independently disposed corresponding to the respective ink jet head constituting sections, whereas the suction pump is disposed in common. At the time of a suction recovery operation, only the atmospheric release valve disposed in the chamber of the suction cap corresponding to the ink jet head constituting section to be sucked/recovered is closed, the atmospheric release valve disposed in the chamber of the suction cap corresponding to the ink jet head constituting section which does not have to be sucked/recovered is opened, and accordingly the ink jet head constituting section to be subjected to the suction recovery operation can be selected.

It is to be noted that here the surface of the ink jet head constituting section 1302 in which the ejection ports for ejecting the ink are formed is capped with the suction cap 1401, and the atmospheric release valve (referred to also as the atmosphere communicating valve) corresponding to the ink jet head constituting section 1302 is closed. When the suction pump 1406 is rotated in this state, the ink in the suction cap, or the ink in the nozzles of the ink jet head constituting section 1302 is drawn in. This is referred to as the suction operation. When the suction operation is performed, the ejected state of the ink from the ink jet head constituting section 1302 can be kept to be satisfactory. It is to be noted that the suction operation is similarly performed with respect to the ink jet head constituting section 1303. The suction cap 1401 for use in the present embodiment has the chambers which can separately seal the ink jet head constituting sections 1302, 1303, respectively. The cap is capable of simultaneously capping both the ink jet head constituting sections 1302, 1303. However, two suction caps may be disposed in such a manner as to separately cap the respective ink jet head constituting sections 1302, 1303.

Figure 11:
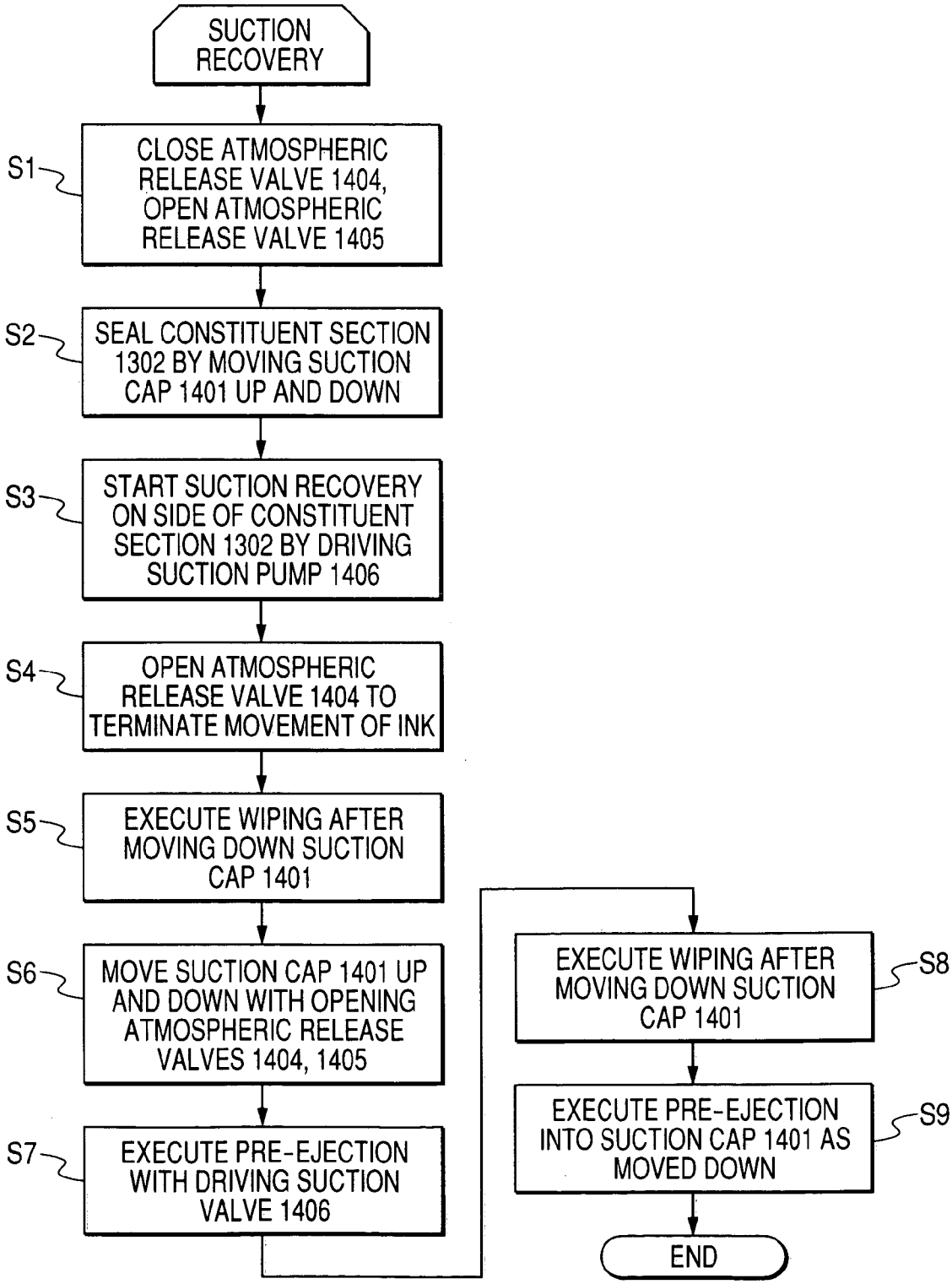
FIG. 11 is an explanatory view of an operation sequence at a time when only an ink jet head constituting section 302 is sucked/recovered.

FIG. 11 shows an operation sequence in a case where the suction recovery operation is performed only with respect to the ink jet head constituting section 1302.

It is to be noted that although not shown in FIG. 10, the operations of the suction cap and the like in the suction recovery are controlled by rotation of a cam shaft and control of gears.

First, the atmospheric release valve 1405 is opened in a state in which the atmospheric release valve 1404 is closed (step 1). Next, the suction cap 1401 is moved up/down, and pressed onto the ink jet recording head 1301 to cap the surface of the ink jet recording head 1301 in which the nozzles are formed (step 2). By the step 2, only the chamber of the suction cap 1401 corresponding to the ink jet head constituting section 1302 is sealed. Next, the suction pump 1406 connected to two ink discharging tubes 1402, 1403 is rotated to perform the suction recovery operation of the ink jet head constituting section 1302 (step 3). It is to be noted that at this time the chamber of the suction cap 1401 corresponding to the ink jet head constituting section 1303 only draws in air from the atmospheric release valve, the recovery operation is not performed in the ink jet head constituting section 1303, and the suction operation is performed only with respect to the ink jet head constituting section 1302. Furthermore, a rotation amount of the suction pump may be changed in accordance with a purpose (an ink amount to be discharged from the ink jet recording head 1301) of the maintenance. Next, when a predetermined suction operation terminates, the atmospheric release valve 1404 is opened to thereby introduce the air into the chamber of the suction cap which has sealed the ink jet head constituting section 1302, and the movement of the ink in the ink jet recording head 1301 is terminated (step 4). Next, the suction cap 1401 is moved down to perform a wiping operation, and the ink droplets left on the surface of the ink jet head constituting section 1302 are wiped off (step 5). Next, the suction cap 1401 is moved up/down while both the atmospheric release valves 1404, 1405 remain opened (step 6). Next, in a state in which the suction cap 1401 abutting on the ink jet recording head 1301 communicates with the atmosphere, the suction pump 1406 is rotated, and pre-ejection is performed from the ink jet head constituting section 1302 (step 7). In the operation of the step 7, ink mist generated during the pre-ejection is ejected into the apparatus to thereby prevent the apparatus from being polluted. Next, after the suction cap 1401 is moved down again, the wiping is performed to wipe off the ink droplet left on the surface of the ink jet head constituting section 1302 (step 8). The pre-ejection is performed in the suction cap 1401 which has moved down (step 9), and a series of operation for the suction recovery ends.

When this operation is performed, the ink jet head constituting sections 1302, 1303 can be selectively sucked/recovered. It is to be noted that to simultaneously perform the suction recovery of the ink jet head constituting sections 1302 and 1303, a series of recovery operation may be performed as described above in a state in which both the atmospheric release valves 1404, 1405 are closed. It is to be noted that after the step 9, the suction pump 1406 may be rotated to thereby control the suction recovery operation in such a manner that the ink in the suction cap 1401 is drawn in.

In this manner, in the present embodiment, the ink jet head constituting section which characterizes the high-speed full-color recording is separated from the ink jet head constituting section which characterizes the recording with the high image quality in the ink jet head as described above, and the respective ink jet head constituting sections can be independently sucked/recovered. Accordingly, without increase the number of the ink tanks (or the nozzle arrays) to be simultaneously sucked/recovered, the ink consumption in the suction recovery can be reduced.

Concretely, for example, assuming that a user uses the high-speed full-color recording in large quantities, the ink jet head constituting section 1302 which characterizes the high-speed full-color recording is mainly used. At this time, in the constitution in which all the colors of ink are simultaneously sucked, when printing defects are generated, or when the ink tank becomes empty, and is replaced, the suction operation is performed not only from the nozzle arrays disposed in the ink jet head constituting section 1302 which characterizes the high-speed full-color recording and used in the recording but also from the nozzle arrays disposed in the ink jet head constituting section 1303 which characterizes the recording with the high image quality and non-used in the recording. Therefore, in the suction operation, although the recording is not performed using the ink jet head constituting section 1303, the ink in the ink jet head constituting section 1303 is consumed. Furthermore, since the ink is discharged from the ink jet head constituting sections 1302, 1303, the amount of waste ink in one suction operation increases, and a size of a waste ink absorbing member for holding the waste ink to be discharged needs to be increased. As a result, the apparatus is enlarged, and the cost is raised. Moreover, as the case may be, the ink tank of the ink jet head constituting section which is not used in the recording instantly becomes empty, and there is also a possibility that the section cannot be used, when the section is to be used.

However, by the application of the present embodiment, when the printing defects are generated, or the ink tank becomes empty and is replaced in the ink jet head constituting section 1302 characterizing the high-speed full-color recording, the suction recovery operation can be performed only with respect to the ink jet head constituting section 1302. Any ink is not discharged from the ink jet head constituting section 1303 characterizing the recording with the high image quality, which has not been used in the recording. Therefore, since the waste ink amount in one suction operation can be reduced as compared with the above-described case, a size of the waste ink absorbing member can be reduced, and the apparatus can be miniaturized.

It is to be noted that here the case where the ink jet head constituting section characterizing the high-speed full-color recording is mainly used has been described but the description also applies to a case where the ink jet head constituting section characterizing the recording with the high image quality is mainly used.

It is to be noted that in the flowchart shown in FIG. 11, the wiping and the pre-ejection after the step 3 of the suction operation are performed only with respect to the ink jet head constituting section subjected to the suction recovery. However, when the suction recovery of one ink jet head constituting section is performed, and the nozzle formed surface of the other ink jet head constituting section becomes dirty, the wiping and the pre-ejection after the suction operation may be performed in both the ink jet head constituting sections.

In this manner, in the present embodiment, an ink ejection nozzle constituting section in which printing with a high image quality is characterized is separated from an ink ejection nozzle constituting section in which high-speed full-color printing is characterized in one ink jet head, and the suction recovery can be performed only with respect to each of the nozzle constituting sections. Therefore, at the time of the suction recovery operation of each nozzle constituting section, optimized maintenance can be performed. Each nozzle constituting section can be subjected to the maintenance at a timing optimum for each nozzle constituting section in accordance with a printing situation (e.g., user's way of printing).

Moreover, in the maintenance during the replacement of one tank of a predetermined nozzle constituting section, the recovery operation is performed only with respect to the ink tank belonging to the same nozzle constituting section, and the recovery operation is not performed with respect to the ink tank belonging to the other nozzle constituting section. Therefore, total ink consumption drawn in at the time of the maintenance can be reduced.

As described above, since the ink amount consumed at the time of the maintenance can be reduced, the size of the apparatus can be prevented from being increased to the utmost.

Second Embodiment

Also in the present embodiment, a recording head constituted in the same manner as in the first embodiment (having the ink jet head constituting section characterizing the high-speed full-color recording and the ink jet head constituting section characterizing the recording with the high image quality) is used. Especially, the present embodiment is characterized in that a suction operation is changed in such a manner as to cope with the structure of each ink jet head constituting section.

The second embodiment of the present invention will be described hereinafter in detail.

Figure 12:
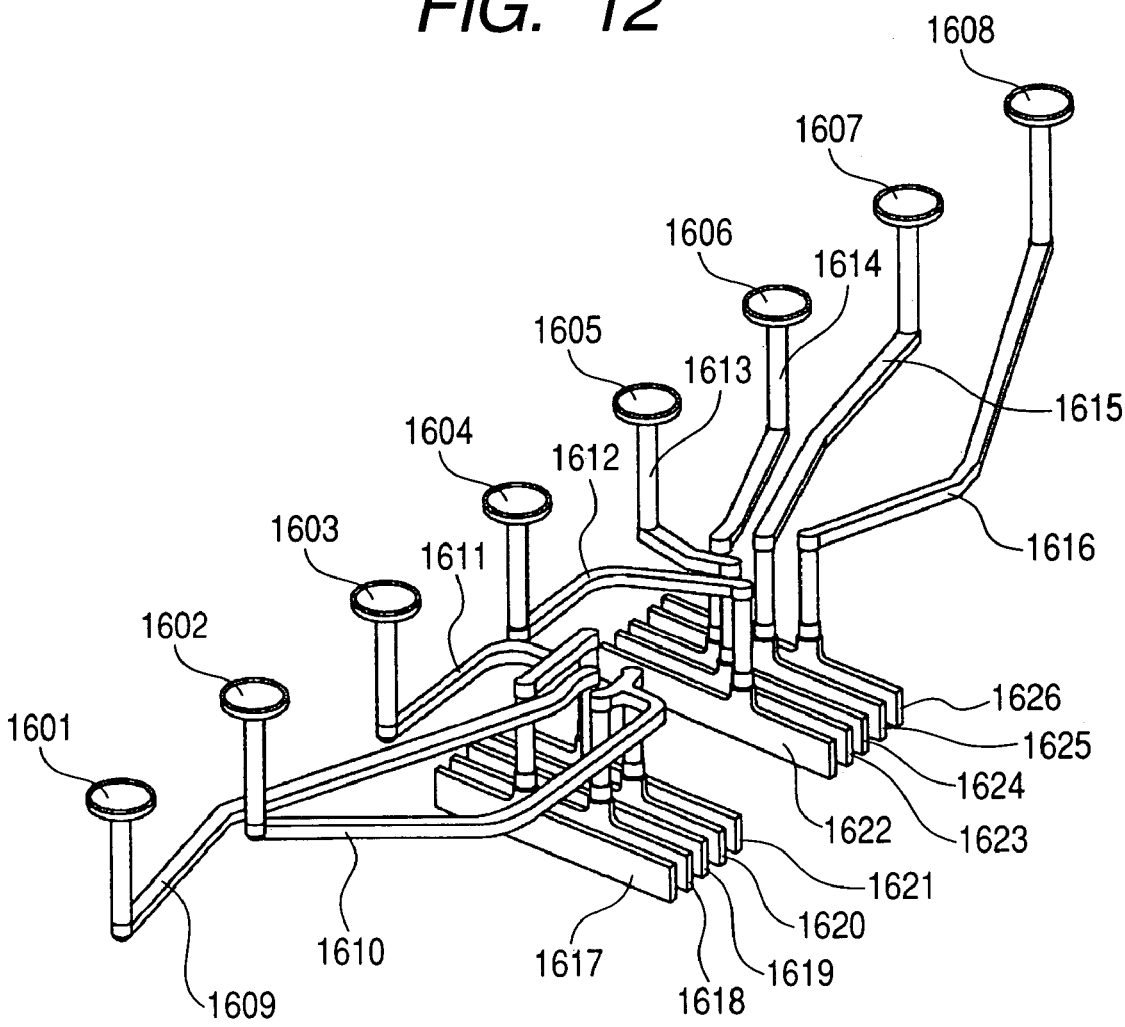
FIG. 12 is a diagram showing an ink channel from an ink tank to an ink ejection port.

FIG. 12 shows a schematic diagram of ink channels from ink tanks to ink ejection ports.

Portions denoted with 1601 to 1608 in the figure are filters, and upper portions thereof are connected to the ink tanks. It is to be noted that the filters 1601 to 1608 are connected to a yellow ink tank, magenta ink tank, cyan ink tank, light cyan ink tank, special ink 1 tank, black ink tank, special ink 2 tank, and light magenta ink tank (not shown) in order. Moreover, portions denoted with 1609 to 1616 are supply paths for supplying the ink from the ink tanks. Furthermore, portions denoted with 1617 to 1626 are solution chambers disposed in such a manner as to stably distribute/supply the ink to a plurality of arranged nozzles.

Next, a constitution from the ink tank to the solution chamber, will be described in each of an ink jet head constituting section 1302 which characterizes high-speed full-color recording and an ink jet head constituting section 1303 which characterizes recording with a high image quality.

Yellow ink belonging to the ink jet head constituting section 1302 is connected to one solution chamber 1619 without bifurcating the supply path 1609 for supplying the ink from the ink tank halfway. In magenta ink and cyan ink, the supply paths 1610, 1611 for supplying the ink from the respective ink tanks are bifurcated halfway, and connected to two solution chambers 1618 and 1620, and 1617 and 1621 constituting symmetric nozzle arrays.

In the present invention, the number of the nozzles per nozzle array formed in the ink jet head, and a size of the ejection port for ejecting ink droplets are equal. Therefore, the number of the nozzles which eject the cyan ink and magenta ink is twice that of the nozzles which eject the yellow ink. Therefore, when all diameters of the ink channels are set to be equal, a flow rate of the cyan ink or the magenta ink having the number of nozzles twice that for the yellow ink is about twice that of the yellow ink. Even in consideration of a pressure loss difference generated by a difference in a supply path structure between cyan and magenta, and yellow, the ink flow rate required for the cyan and magenta ink tanks is far larger than that for yellow.

However, there is a restriction as to an ink supply capability originally assured by the ink tank. When supply exceeding the restriction is required, there is a problem that the supply becomes impossible, or air is generated as bubbles in the tank or from a connection portion between the tank and the ink channel. Therefore, to perform the suction recovery operation of the ink jet head constituting section 1302, the ink tank is required not to cause the above-described problems in a cyan or magenta section in which a required ink flow rate is large. Moreover, a suction recovery property of a yellow section in which the ink flow rate is relatively reduced is required to be secured.

Concretely, assuming a state in which the ink in the supply path 1609 and solution chamber 1619 of the yellow ink is completely emptied, when the suction recovery is executed with an ink flow rate adjusted for cyan and magenta, the ink flow rate is excessively small for the yellow ink tank having the ink supply path that is not bifurcated, and therefore an ink filling property of the yellow section is considerably deteriorated. On the other hand, when the ink flow rate is increased for yellow in order to securely fill the yellow section, an excessive ink flow rate is applied to the ink tanks of the cyan and magenta sections. This causes problems that the ink cannot be supplied and that air bubbles are generated in the tank or from the connection portion between the tank and the ink channel.

On the other hand, for the ink belonging to the ink jet head constituting section 1303, all the ink supply paths are not bifurcated in the same manner as in the yellow of the ink jet head constituting section 1302. That is, in the ink jet head constituting section 1303, there is not any ink tank having the bifurcated supply path unlike the ink jet head constituting section 1302. Therefore, the restriction on the flow rate of the ink tank is all the same, and necessarily optimum suction recovery conditions are largely different from those of the ink jet head constituting section 1302.

In the present embodiment, to cope with the ink jet head constituting sections having different constitutions, for example, the ink jet head constituting section 1302 having a constitution in which the supply path for supplying the ink to the nozzle array from the ink tank is branched, and the ink jet head constituting section 1303 constituted in such a manner that the supply path is not branched, different sequences of the suction recovery are performed for each ink jet head constituting section.

Figure 13:
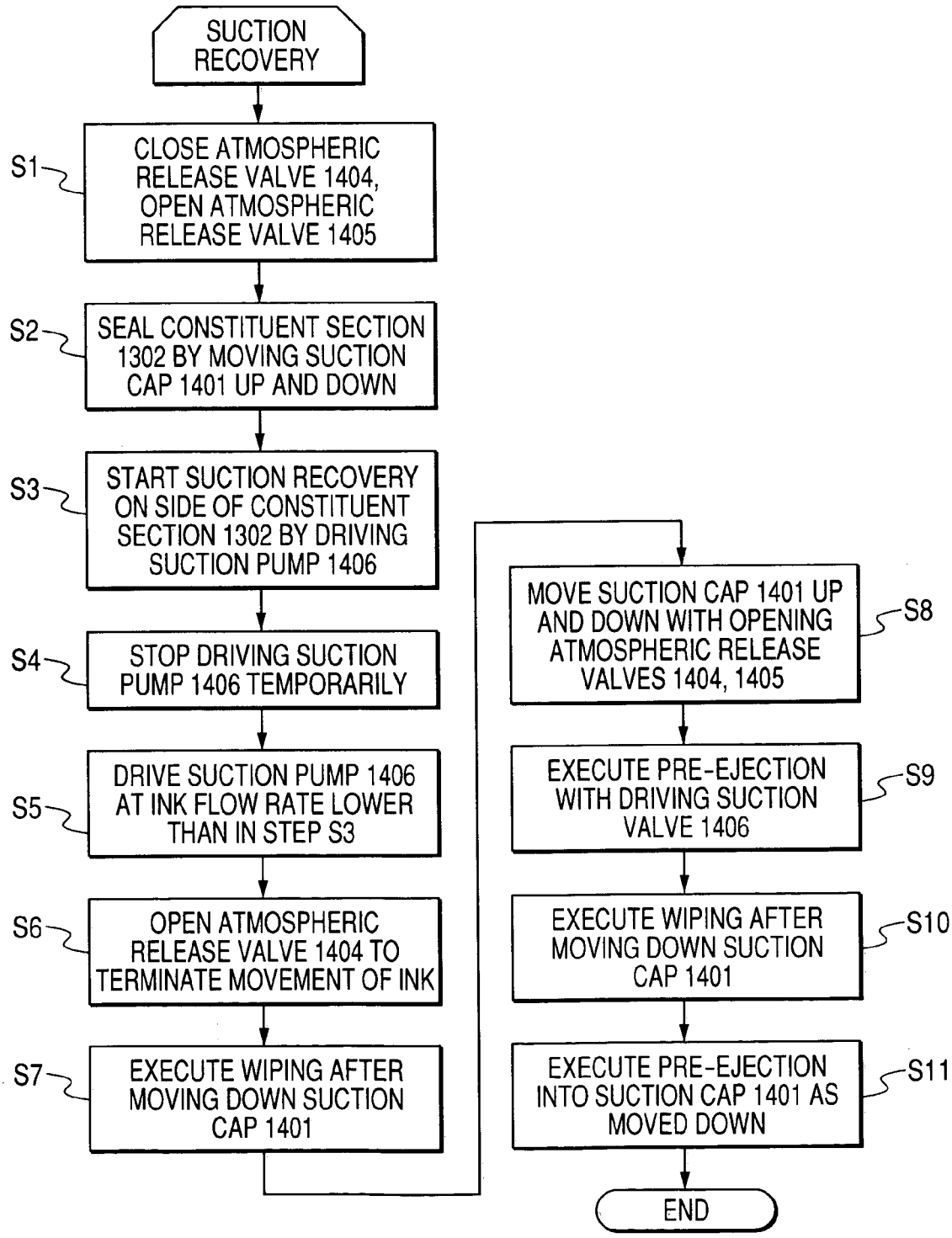
FIG. 13 is a flowchart of a suction recovery sequence at a time when an ink jet head constituting section 1302 is sucked/recovered.

When the suction recovery is performed with respect to the ink jet head constituting section 1302, the excessive ink flow rates are applied to the cyan ink and the magenta ink, and there is fear that the problems of the emptied ink tank, the generation of the bubbles and the like are caused. However, the ink tank can structurally withstand the ink flow rate exceeding the restriction for a short time. Therefore, properties of the ink tank are considered in the operation sequence shown in FIG. 11, and a flow of a suction recovery sequence optimized for the suction recovery of the ink jet head constituting section 1302 is shown in FIG. 13.

Since the process of steps S1 to S3 is similar to that of FIG. 11, the description thereof is omitted. It is to be noted that in the step S3, a suction pump is preferably rotated to such an extent that a high ink flow rate is generated in a short time in a range that does not cause the above-described problems. Concretely, in experiments by the present inventors, the ink flow rate generated in a suction pump section was set to 6 g/min. on average. This value was determined, after it was possible to confirm that the ink tank did not cause any problem within one to two seconds even under an environment at a low temperature under which ink viscosity rose to 4 cp. When the ink flow rate was continuously applied for two or more seconds, the cyan and magenta ink tanks did not supply sufficient ink, air was drawn in from a structural portion where air easily moved, the air flowed as the bubbles into the ink supply path, and the subsequent printing was sometimes adversely affected. When the ink flow rate is increased as much as possible for such a short time to such an extent that the cyan and magenta ink tanks do not cause the above-described problems, the flow of the yellow ink from the tank section into the ink supply path is started as fast as possible, and the filling property can be enhanced.

When the suction operation ends in the step S3, the rotation of the suction pump is temporarily stopped in consideration of loads on the cyan and magenta ink tanks (step S4), and the suction pump is rotated in such a manner that an ink flow rate lower than that of the step 3 is generated (step S5). The process of the steps S4 and S5 may be repeated a plurality of times in accordance with an amount of the ink discharged in the ink jet head constituting section 1302. For example, when the rotation of the suction pump is stopped for about 200 μSec in the step S4, the ink flow rate excessive for the ink tank is once lowered. In the step S5, the suction pump is rotated at about 80% of a rotation amount of the suction pump in the step 3, and again the rotation of the suction pump is stopped for about 100 μSec. Thereafter, the rotating and stopping of the suction pump are repeated several times until a predetermined amount of ink is discharged from the ink jet head constituting section 1302. When the rotating and stopping of the suction pump are repeated several times in this manner, the ink flow rate lowered in the step S4 can be stably continued. However, the ink flow rate at this time is rather low for the yellow section. To improve the filling property or a bubble removing property, a total flowing amount (suction amount) is set to be slightly large, and the filling property and bubble removing property of the yellow section are satisfied. That is, a slightly large amount of ink is discharged from the yellow section. However, since a strong suction operation of the step S3 is performed, the ink consumption is minimized.

When a predetermined suction amount is secured, the process advances to step S6. It is to be noted that since the process of steps S6 to S11 shown in FIG. 13 is similar to that of the steps S4 to S9 of FIG. 11, the description thereof is omitted.

On the other hand, when the ink jet head constituting section 1303 is sucked/recovered, it may be considered that the yellow tanks of the ink jet head constituting section 1302 are arranged as many as the number of the colors, because there is not any bifurcated ink supply path structure, unlike cyan and magenta. Therefore, an ink flow rate restriction is considerably high as compared with the ink jet head constituting section 1302. Then, the properties of the ink tank are considered based on the operation sequence shown in FIG. 11, and a flow of a suction recovery sequence optimized for performing the suction recovery of the ink jet head constituting section 1303 is shown in FIG. 14.

Figure 14:
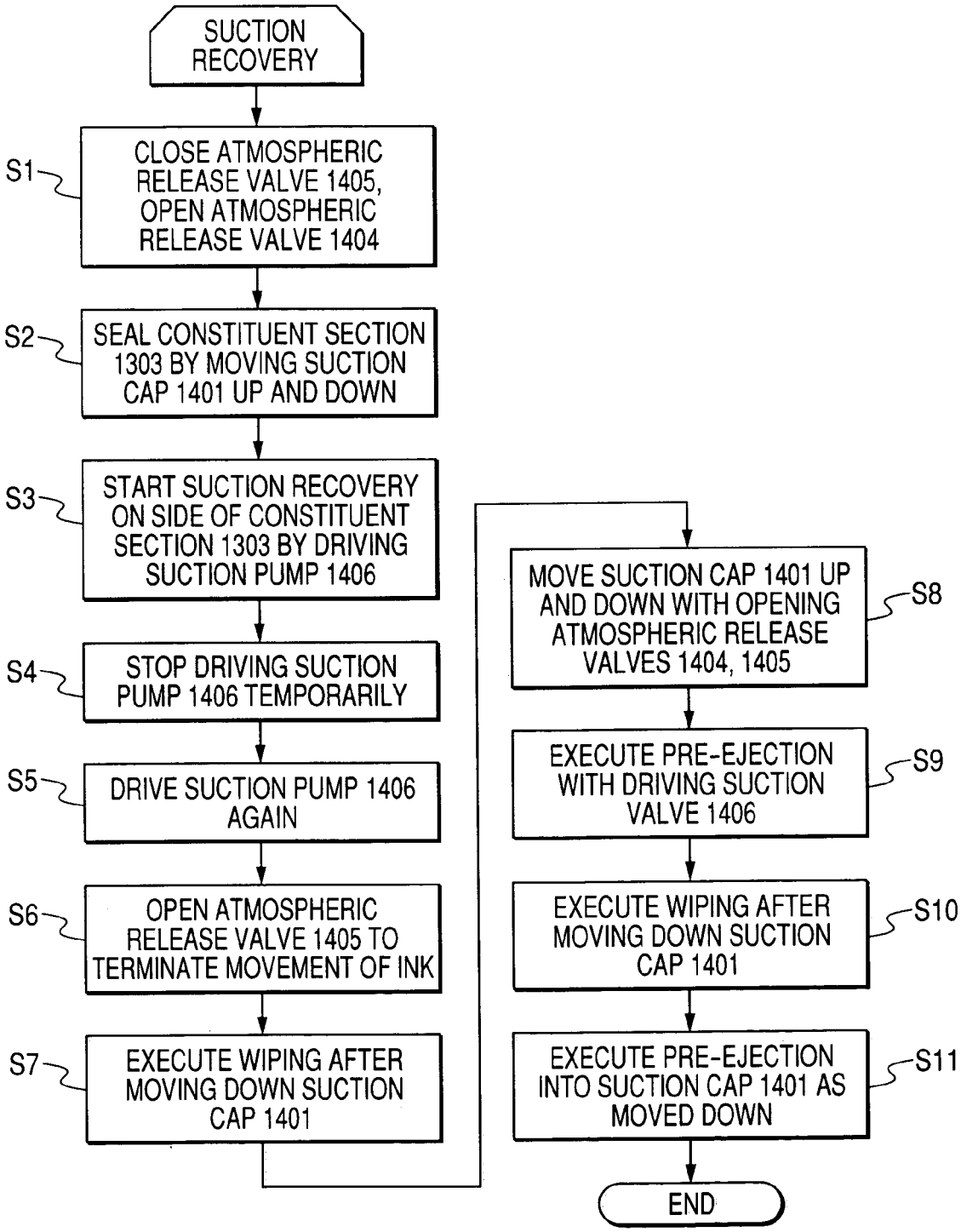
FIG. 14 is a flowchart of the suction recovery sequence at a time when an ink jet head constituting section 1303 is sucked/recovered.

First, the atmospheric release valve 1404 is brought into an open state in a state in which the atmospheric release valve 1405 is closed (step S1 in FIG. 14). Next, the suction cap 1401 is moved up/down, and pressed onto the ink jet recording head 1301 to cap the surface of the ink jet recording head 1301 in which the nozzles are formed (step S2). By the step S2, only the chamber of the suction cap 1401 corresponding to the ink jet head constituting section 1303 is sealed. Next, the suction pump 1406 connected to two ink discharging tubes 1402, 1403 is rotated, and the suction recovery operation of the ink jet head constituting section 1303 is performed (step S3). At this time, the suction pump is preferably rotated in such a manner that a high ink flow rate is generated in a short time in a range that does not cause the above-described problems. For example, in experiments by the present inventors, the ink flow rate generated in a suction pump section was set to 6 g/min. on average. This value was determined because it was possible to confirm that the ink tank did not cause any problem within five to six seconds even under an environment at a low temperature under which ink viscosity rose to 4 cp. When the ink flow rate was continuously applied for six or more seconds, one of the ink tanks of black, light cyan, light magenta, special ink 1, and special ink 2 did not supply sufficient ink, air was drawn in from a structural portion where air easily moved, the air flowed as the bubbles into the ink supply path, and the subsequent printing was sometimes adversely affected. When the ink flow rate is increased as much as possible to such an extent that any ink tank does not cause any problem in this manner, the flow from the tank section of each ink into the ink supply path is started as fast as possible, the filling property and bubble removing property are enhanced, and the suction amount of each ink (amount of discharged ink) can be minimized.

Next, when the suction operation ends, the rotation of the suction pump is temporarily stopped (step S4), and the suction pump is rotated again (step S5). The process of the steps S4 and S5 may be repeated a plurality of times in accordance with the amount of the ink discharged in the ink jet head constituting section 1302. For example, when the rotation of the suction pump is stopped for about 100 μSec in the step S4, the ink flow rate for the ink tank is prevented from being increased to a predetermined or more rate. In the step S5, the suction pump is rotated at a rotation amount equal to that of the step S3, and again the rotation is stopped for about 100 μSec. Thereafter, the rotating and stopping of the suction pump are repeated several times until a predetermined amount of ink is discharged from the ink jet head constituting section 1303. When the rotating and stopping of the suction pump are repeated, the ink flow rate is stably continued. Accordingly, since the ink flow rate is kept to be as high as possible in each ink section, the filling property or the bubble removing property is improved. As a result, a total flowing amount can be suppressed.

When a predetermined suction amount is secured, the atmospheric release valve 1405 is released, accordingly air is introduced into the chamber of the suction cap that has sealed the ink jet head constituting section 1303, and the movement of the ink in the ink jet recording head 1301 is ended (step S6). Next, the suction cap 1401 is moved down, the wiping operation is performed, and accordingly the ink droplets left on the surface of the ink jet head constituting section 1303 is wiped off (step S7). Next, while the atmospheric release valves 1404, 1405 remain released, the suction cap 1401 is moved up/down (step S8). Next, in a state in which the suction cap 1401 abutting on the ink jet recording head 1301 communicates with the atmosphere, the suction pump 1406 is rotated, and pre-ejection is performed from the ink jet head constituting section 1303 (step S9). Next, after the suction cap 1401 is moved down, the wiping is performed, the ink droplets left on the surface of the ink jet head constituting section 1303 are wiped off (step S10), the pre-ejection is carried out in the suction cap 1401 which has moved down (step S11), and a series of operation for the suction recovery ends.

By the use of the present embodiment in this manner, the suction recovery sequence optimum for each of the ink jet head constituting sections 1302, 1303 having different structures can be carried out with an ink flow rate which has been raised as much as possible. Therefore, the total amount of discharged ink can be reduced. That is, the ink is not excessively drawn in.

Figure 15:
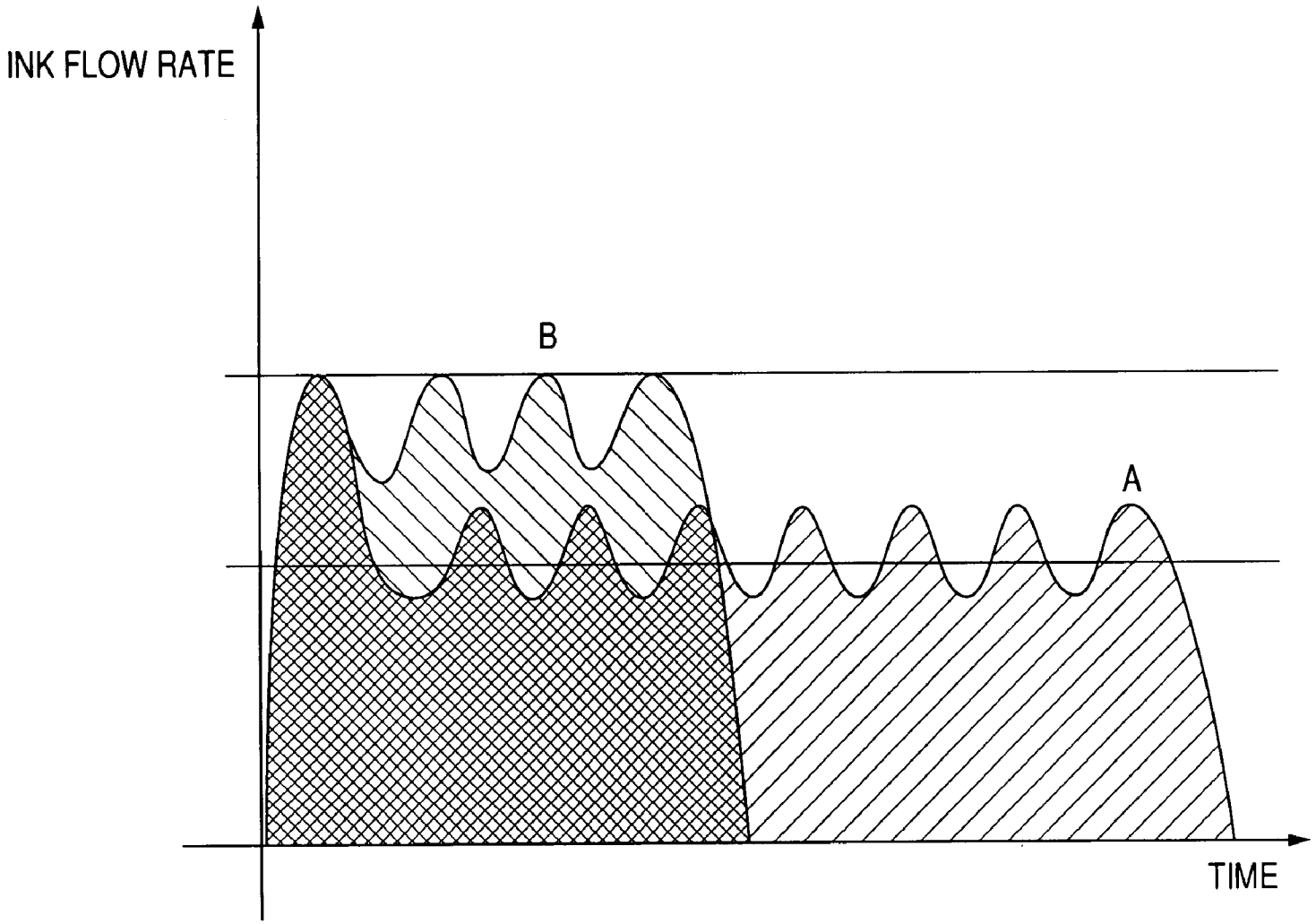
FIG. 15 is a diagram showing suction amounts in the ink jet head constituting sections 1302 and 1303.

Here, FIG. 15 shows a graph showing the suction amounts at a time when the recovery operation of the present embodiment is performed in the respective ink jet head constituting sections. In FIG. 15, X-axis indicates time, and Y-axis indicates the ink flow rate. A relation between the ink flow rate and time by the suction recovery sequence of the ink jet head constituting section 1302 shown in FIG. 13 is shown by a curve A, and a relation between the ink flow rate and time by the suction recovery sequence of the ink jet head constituting section 1303 shown in FIG. 14 is shown by a curve B. Differences between the ink jet head constituting sections in the characteristics of the suction recovery and the suction amount are well seen from FIG. 15.

Unlike the ink jet head constituting section 1303, the high ink flow rate cannot be continuously applied in the suction recovery of the ink jet head constituting section 1302. Therefore, in initial and subsequent stages, the ink flow rate is lowered, and the suction operation is performed for a long time in order to secure the ink filling property and the bubble removing property. It is to be noted that an area shown by slant lines on the left side of the graph indicates a total suction amount. On the other hand, since the high ink flow rate can be applied in the ink jet head constituting section 1303 as compared with the ink jet head constituting section 1302, the ink filling property and the bubble removing property can be secured in a comparatively short time. It is to be noted that an area shown by slant lines on the right side of the graph indicates a total suction amount.

In the suction recovery operation of the ink jet head constituting section 1302, the suction operation is controlled in such a manner that the suction amount is not excessive, but as apparent from comparison of both the areas shown by the slant lines, the total suction amount of the suction recovery of the ink jet head constituting section 1302 is large.

Here, the suction recovery operation will be described hereinafter in which all colors of ink are simultaneously drawn in without using the recording head and the constitution of recovery means in the present invention. In this constitution, the suction recovery operation is set based on the ink flow rates of cyan and magenta for which the ink supply paths are bifurcated. Therefore, the suction recovery operation similar to that of the ink jet head constituting section 1302 of the present embodiment is performed. In this case, an excessive amount of ink is sucked from the ink tank in which the ink supply path is not bifurcated in such a manner as to cope with the ink jet head constituting section of the present embodiment. As a result, ink consumption also increases. Conversely, if the suction recovery operation is performed based on the ink flow rate of the ink supply path that is not bifurcated, problems are generated in bifurcated ink supply paths of cyan and magenta.

Also in the present embodiment, when the optimum suction recovery sequence is executed in such a manner as to cope with the respective constituting sections having different structures, an effect of reducing the ink consumption at the time of the maintenance can be obtained.

It is to be noted that in the present embodiment, light cyan ink, light magenta ink, black ink, special ink 1, and special ink 2 are disposed in the constituting section 1303 which performs the printing with the high image quality. However, if special ink 3 is mounted without mounting light cyan ink and light magenta ink, light black ink is mounted in order to enhance gradation and gray balance of a monochromatic image, or a solution composition for controlling gloss is mounted, any problem is not caused. It is to be noted that by miniaturization of ink solution droplets, an output image is obtained only by the ejection of the ink droplets by the cyan ink and magenta ink to such an extent that grained states are not sufficiently noticed. In this case, it is considered that the light cyan ink and light magenta ink are not mounted.

Moreover, in the present embodiment, in the ink jet head constituting section 1302, the nozzle arrays which eject the ink are arranged symmetrically with respect to the scanning direction of the recording head. However, when the predetermined ink jet head constituting section includes the bifurcated supply path, and the other ink jet head constituting section includes the supply path that is not bifurcated, the nozzle arrays of the predetermined ink jet head constituting section do not have to be symmetrically disposed.

Third Embodiment

In the present embodiment, in addition to the constitutions of the recording heads of the first and second embodiments, a recording head having an ink jet head constituting section which ejects further different solution is used.

Figure 16:
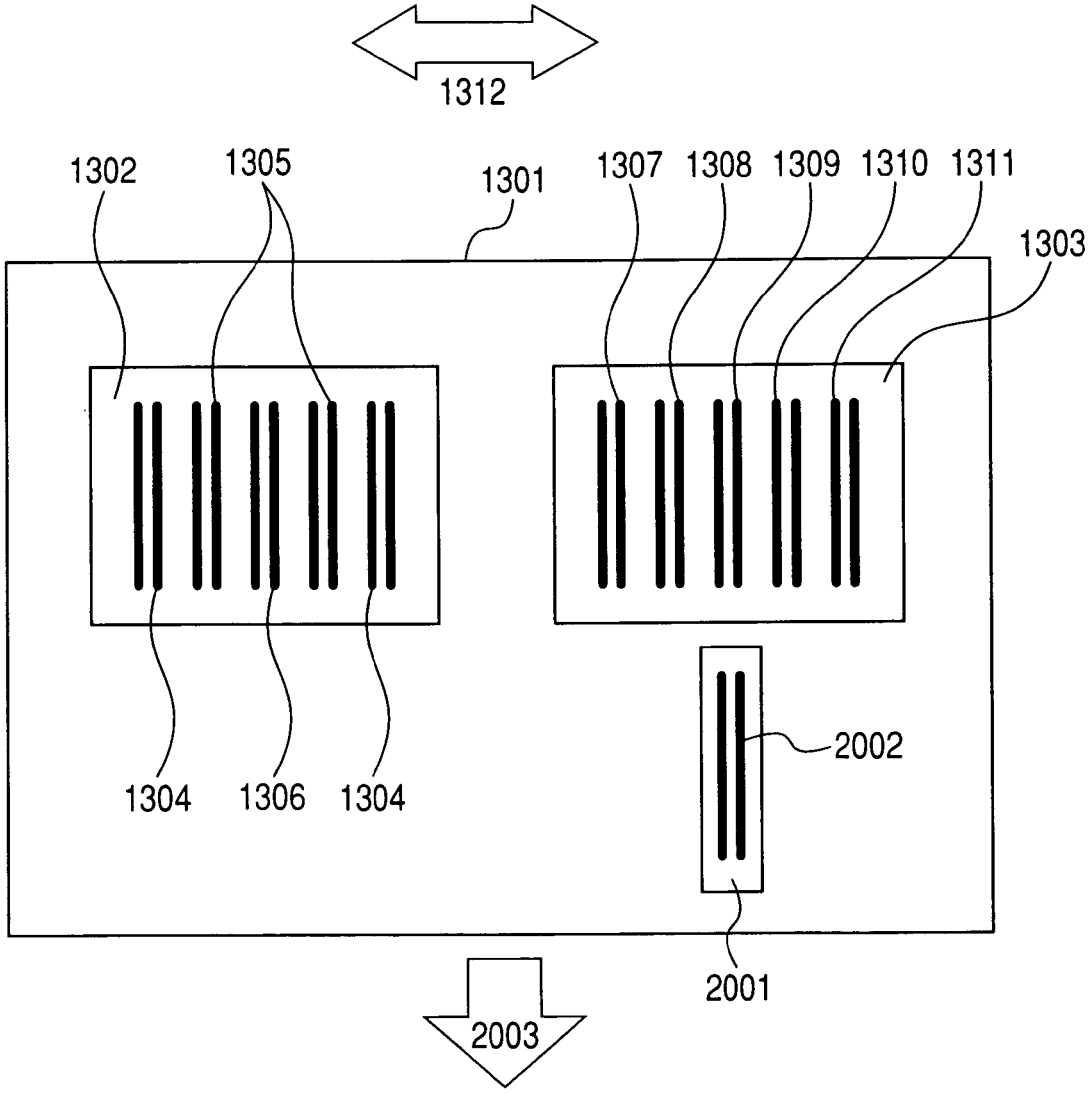
FIG. 16 is a diagram showing a constitution of the ink jet head in a third embodiment.

FIG. 16 shows a constitution diagram of the ink jet head in the present embodiment. In the present embodiment, portions having functions similar to those of the first and second embodiments are denoted with the same reference numerals, and detailed description thereof is omitted.

In FIG. 16, reference numeral 1301 denotes an ink jet head, 1302 denotes an ink jet head constituting section which characterizes high-speed full-color recording, and 1303 denotes an ink jet head constituting section which characterizes recording with a high image quality. The structures of the ink jet head constituting sections 1302, 1303 are similar to those of the first and second embodiments.

Reference numeral 2001 denotes an ink jet head constituting section which characterizes the recording with the high image quality and which especially controls a gloss degree. The section is disposed in a downstream position in a feeding direction 2003 of a recording medium in an ink jet recording apparatus. 2002 denotes a pair of nozzle arrays which eject a solution composition for controlling gloss. After a high-quality image is formed on the recording medium by each color of ink disposed in the ink jet head constituting sections 1302, 1303, the solution composition in the present embodiment is ejected/applied toward the recording medium, and an gloss effect or a stereoscopic effect of the image, which is not easily represented only by color reproduction, is represented. The solution composition for controlling the gloss is by another invention by the present inventors. After the application of the solution composition, surface roughness can be controlled. When the surface roughness is reduced (smoothness is raised), the gloss effect is increased. The surface roughness is increased (the smoothness is lowered), scattering is intentionally increased, and the surface can be fogged.

The above-described controlling of the gloss property is also in a category for forming the high-quality image, and the ink jet head constituting section 1302 can be said to be substantially equal to the ink jet head constituting section 1303 which characterizes the recording with the high image quality considering a use situation.

Therefore, in the present embodiment, the ink jet head constituting section 1303 and the ink jet head constituting section 2001 which are different from each other in constitution but which match each other in a use purpose of the recording with the high image quality are simultaneously subjected to suction recovery. That is, when chambers for suction in the suction cap 1401 are allocated, the same chamber is allocated to the ink jet head constituting sections 1303 and 2001, and accordingly an effect similar to that of the second embodiment is obtained.

It is to be noted that in the present embodiment, light cyan ink, light magenta ink, black ink, special ink 1, and special ink 2 are disposed in the ink jet head constituting section 1303 which characterizes the recording with the high image quality. However, any problem is not caused, even if special ink 3 is mounted without mounting the light cyan ink and the light magenta ink, or light black ink is mounted for enhancing a gradation and gray balance of a monochromatic image.

Furthermore, even when an ejection performance or a maintenance property of an ink system described in the related art is influenced by color mixture corresponding to (2) to (5), but when the present invention is applied to ink species that do not cause any problem even by the color mixture, a similar effect is obtained.

This application claims priority from Japanese Patent Application No. 2003-297679 filed Aug. 21, 2003, which is hereby incorporated by reference herein.

What is claimed is:

1. An ink jet recording apparatus for performing recording on a recording medium by use of a recording head including a first nozzle array group in which a plurality of nozzle arrays having a plurality of nozzels for ejecting ink are arranged corresponding to a plurality of colors of the ink, and a second nozzle array group in which a plurality of nozzle arrays having a plurality of nozzels for ejecting at least one of ink and solution are arranged corresponding to a plurality of colors different from those ejected from the first nozzle array group the apparatus comprising:

recovery process means capable of individually performing recovery processes for keeping ejection states satisfactory in the first and second nozzle array groups, wherein the recovery process means performs the recovery process with respect to the first nozzle array group for a time longer than that of the recovery process with respect to the second nozzle array group.

2. The apparatus according to claim 1, wherein the recovery process means is capable of executing the recovery process with respect to the first nozzle array group, and the recovery process with respect to the second nozzle array group, which is different from that with respect to the first nozzle array group.

3. The apparatus according to claim 1, further comprising:

capping means for allowing a first cap for capping the plurality of nozzle arrays of the first nozzle array group and a second cap for capping the plurality of nozzle arrays of the second nozzle array group to abut on surfaces of the first and second nozzle array groups in which the nozzles are formed, or for detaching the first and second caps from the surfaces of the first and second nozzle array groups;

a communicating valve capable of individually connecting the inside of the first cap or that of the second cap to the atmosphere; and suction means for causing a negative pressure in the first cap or the second cap to thereby suck the ink from the nozzles of the nozzle array group corresponding to the cap for which the communicating valve is closed.

4. The apparatus according to claim 3, wherein the suction means rotates a suction pump to thereby cause the negative pressure in the first cap or the second cap, and the suction means repeats the rotating and stopping of the suction pump to suck a predetermined amount of ink from the nozzles of the nozzle array group.

5. The apparatus according to claim 3, wherein the suction means rotates a suction pump to thereby cause the negative pressure in the first cap or the second cap, and the recovery process means sets a rotation amount of the suction pump at a time when the recovery process is performed with respect to the first nozzle array group to be smaller than that of the suction pump at a time when the recovery process is performed with respect to the second nozzle array group.

6. The apparatus according to claim 1, further comprising:

first wiping means for wiping off ink attached to the a surface of first nozzle array group in which the nozzles are formed; and second wiping means for wiping off ink attached to a surface of the second nozzle array group in which the nozzles are formed, wherein the recovery process means performs the recovery process of the first nozzle array group or the second nozzle array group using the first wiping means or the second wiping means.

7. The apparatus according to claim 1, wherein the recovery process means performs the recovery process of the first nozzle array group or the second nozzle array group in accordance with an ink ejection state of the first nozzle array group or the second nozzle array group.

8. The apparatus according to claim 1, wherein the recording head comprises a supply path which supplies the ink to the nozzle arrays from an ink tank storing a predetermined color of ink among a plurality of colors of ink ejected from the first nozzle array group and which is branched, and a supply path which supplies the ink or the solution to the nozzle arrays from a tank storing the ink or the solution ejected from the second nozzle array group and which is not branched.

9. The apparatus according to claim 8, wherein the first nozzle array group includes a plurality of nozzle arrays which eject the ink stored in a predetermined ink tank, and the nozzle arrays which eject the plurality of colors of ink are arranged symmetrically in a scanning direction in which the recording head reciprocates/moves.

10. The apparatus according to claim 1, wherein the first nozzle array group and the second nozzle array group are formed in semiconductor chips which are different from each other, respectively.

11. An ink jet recording apparatus for performing recording on a recording medium by use of a recording head including a first nozzle array group in which a plurality of nozzle arrays having a plurality of nozzels for ejecting ink are arranged corresponding to a plurality of colors of the ink, and a second nozzle array group in which a plurality of nozzle arrays having a plurality of nozzels for ejecting at least one of ink and solution are arranged corresponding to a plurality of colors different from those ejected from the first nozzle array group, the apparatus comprising:

recovery process means capable of individually performing recovery processes for keeping ejection states satisfactory in the first and second nozzle array groups, wherein the first nozzle array group ejects yellow ink, magenta ink, and cyan ink, and the second nozzle array group ejects color ink having colors different from those of the ink ejected from the first nozzle array group.

12. The apparatus according to claim 11, wherein the ink including black ink, light cyan ink, and light magenta ink is ejected from the second nozzle array group.

13. The apparatus according to claim 11, wherein at least one of orange ink, green ink, and blue ink is ejected from the second nozzle array group.

14. An ink jet recording apparatus for performing recording on a recording medium by use of a recording head including a first nozzle array group in which a plurality of nozzle arrays having a plurality of nozzels for ejecting ink are arranged corresponding to a plurality of colors of the ink, and a second nozzle array group in which a plurality of nozzle array having a plurality of nozzels for ejecting at least one of ink and solution are arranged corresponding to a plurality of colors different from those ejected from the first nozzle array group, the apparatus comprising:

recovery process means capable of individually performing recovery processes for keeping ejection states satisfactory in the first and second nozzle array groups.

wherein the solution ejected from the second nozzle array group is a solution which is ejected to the recording medium to thereby enhance a gloss degree of the recording medium.

15. A maintenance method of a recording head in an ink jet recording apparatus for performing recording on a recording medium by use of the recording head including a first nozzle array group in which a plurality of nozzle arrays having a plurality of nozzels for ejecting ink are arranged corresponding to a plurality of colors of the ink, and a second nozzle array group in which a plurality of nozzle arrays having a plurality of nozzels for ejecting at least one of ink and solution are arranged corresponding to a plurality of colors different from those ejected from the first nozzle array group he method comprising:

a recovery process step capable of individually performing recovery processes for keeping ejection states satisfactory in the first and second nozzle array groups, wherein the recovery process step performs the recovery process with respect to the first nozzle array group for a time longer than that of the recovery process with respect to the second nozzle array group.

16. The method according to claim 15, wherein the recovery process step is capable of executing the recovery process with respect to the first nozzle array group, and the recovery process with respect to the second nozzle array group, which is different from that with respect to the first nozzle array group.

17. The method according to claim 15, wherein the recovery process step comprises the step of performing the recovery process of the first nozzle array group or the second nozzle array group in accordance with an ink ejection state of the first nozzle array group or the second nozzle array group.

18. The method according to claim 17, wherein the ink jet recording apparatus comprises capping means for allowing a first cap for capping the plurality of nozzle arrays of the first nozzle array group and a second cap for capping the plurality of nozzle arrays of the second nozzle array group to abut on surfaces of the first and second nozzle array groups in which the nozzles are formed, or for detaching the first and second caps from the surfaces of the first and second nozzle array groups, a communicating valve capable of individually connecting the inside of the first cap or that of the second cap to the atmosphere, and suction means for causing a negative pressure in the first cap or the second cap by the use of a suction pump to thereby suck the ink from the nozzles of the nozzle array group corresponding to the cap for which the communicating valve is closed, and the recovery process step comprises the step of repeating rotating and stopping of the suction pump to suck a predetermined amount of ink from the nozzles of the nozzle array group.

19. The method according to claim 18, wherein the recovery process step comprises the step of setting a rotation amount of the suction pump time when the recovery process is performed with respect to the first nozzle array group to be smaller than that of the suction pump at a time when the recovery process is performed with respect to the second nozzle array group.

20. An ink jet recording apparatus for performing recording on a recording medium by use of a recording head including a first nozzle array group in which a plurality of nozzle arrays having a plurality of nozzels for ejecting ink are arranged corresponding to a plurality of colors of the ink, and a second nozzle array group in which a plurality of nozzle arrays having a plurality of nozzels for ejecting at least one of ink and solution are arranged corresponding to a plurality of colors different from those ejected from the first nozzle array group, the apparatus comprising:

recovery process means capable of individually performing recovery processes for keeping ejection states satisfactory in the first and second nozzle array groups, wherein the recording head comprises a supply path which supplies the ink to the nozzle arrays from an ink tank storing a predetermined color of ink among a plurality of colors of ink ejected from the first nozzle array group and which is branched, and a supply path which supplies the ink or the solution to the nozzle arrays from a tank storing the ink or the solution ejected from the second nozzle array group and which is not branched.

21. An ink jet recording apparatus for performing recording on a recording medium by use of a recording head including a first nozzle array group in which a plurality of nozzle arrays having a plurality of nozzels for ejecting ink are arranged corresponding to a plurality of colors of the ink, and a second nozzle array group in which a plurality of nozzle arrays having a plurality of nozzels for ejecting at least one of ink and solution are arranged corresponding to a plurality of colors different from those ejected from the first nozzle array group, the apparatus comprising:

recovery process means capable of individually performing recovery processes for keeping ejection states satisfactory in the first and second nozzle array groups;

capping means for allowing a first cap for capping the plurality of nozzle arrays of the first nozzle array group and a second cap for capping the plurality of nozzle arrays of the second nozzle array group to abut on surfaces of the first and second nozzle array groups in which the nozzles are formed, or for detaching the first and second caps from the surfaces of the first and second nozzle array groups;

a communicating valve capable of individually connecting the inside of the first cap or that of the second cap to the atmosphere; and suction means for causing a negative pressure in the first cap or the second cap to thereby suck the ink from the nozzles of the nozzle array group corresponding to the cap for which the communicating valve is closed, wherein the suction means rotates a suction pump to thereby cause the negative pressure in the first cap or the second cap, and the recovery process means sets a rotation amount of the suction pump at a time when the recovery process is performed with respect to the first nozzle array group to be smaller than that of the suction pump at a time when the recovery process is performed with respect to the second nozzle array group.

* * * * *

UNITED STATES PATENT AND TRADEMARK OFFICE

CERTIFICATE OF CORRECTION

PATENT NO. : 7,207,649 B2
APPLICATION NO. : 10/921213
DATED : April 24, 2007
INVENTOR(S) : Ide et al.

It is certified that error appears in the above-identified patent and that said Letters Patent is hereby corrected as shown below:

COLUMN 16:
Line 33, “are-” should read --are--.

COLUMN 22:
Line 40, “group” should read --group,--.

COLUMN 23:
Line 18, “the” should be deleted.

COLUMN 24:
Line 4, “the” should be deleted.
Line 16, “array” should read --arrays--.
Line 37, “he” should read --the--.

COLUMN 25:
Line 11, “pump time” should read --pump at a time--.

Signed and Sealed this

Twenty-fourth Day of February, 2009

JOHN DOLL
*Acting Director of the United States Patent and Trademark Office*